US005796336A

United States Patent [19]

Ishino et al.

[11] Patent Number: 5,796,336

[45] Date of Patent: Aug. 18, 1998

[54] GLASS BREAKAGE DETECTING DEVICE

[75] Inventors: Hirotugu Ishino, Toyohashi; Akira Kurahashi, Nukata-gun, both of Japan

[73] Assignee: Denso Corporation, Kariya, Japan

[21] Appl. No.: 813,659

[22] Filed: Mar. 7, 1997

[30] Foreign Application Priority Data

| | | | |
|---|---|---|---|
| Mar. 8, 1996 | [JP] | Japan | 8-080843 |
| Mar. 8, 1996 | [JP] | Japan | 8-080844 |
| Dec. 20, 1996 | [JP] | Japan | 8-355074 |

[51] Int. Cl.[6] ..... G08B 13/00

[52] U.S. Cl. ..... 340/566; 340/550; 340/544

[58] Field of Search ..... 340/541, 544, 340/550, 566, 522, 540, 545

[56] References Cited

U.S. PATENT DOCUMENTS

| | | | |
|---|---|---|---|
| 4,134,109 | 1/1979 | McCormick et al. | 340/550 |
| 4,333,093 | 6/1982 | Raber et al. | 340/566 |
| 4,837,558 | 6/1989 | Abel et al. | 340/550 |
| 4,853,677 | 8/1989 | Yarbrough et al. | 350/554 |
| 5,117,220 | 5/1992 | Marino et al. | 340/550 |
| 5,192,931 | 3/1993 | Smith et al. | 340/541 |
| 5,323,141 | 6/1994 | Petek | 340/541 |
| 5,504,717 | 4/1996 | Sharkey et al. | 367/124 |
| 5,510,767 | 4/1996 | Smith | 340/550 |
| 5,515,029 | 5/1996 | Zhevelev et al. | 340/550 |
| 5,543,783 | 8/1996 | Clark et al. | 340/550 |

FOREIGN PATENT DOCUMENTS

| | | |
|---|---|---|
| 62-197891 | 9/1987 | Japan . |
| 4-500727 | 2/1992 | Japan . |
| 2284668 | 6/1995 | United Kingdom . |
| 2291502 | 1/1996 | United Kingdom . |

*Primary Examiner*—Brent A. Swarthout
*Assistant Examiner*—Van T. Trieu
*Attorney, Agent, or Firm*—Cushman Darby Cushman IP Group of Pillsbury Madison & Sutro LLP

[57] ABSTRACT

To improve accuracy in detection of glass breakage, a microphone converts a glass breaking sound into an electrical signal, and high-pass filters and extract high frequency components of 2 kHz or higher and 150 Hz or higher, respectively, from the signal. A half-wave rectifier circuit half-wave rectifies these signals and an amplifier amplifies them. The output of the amplifier is smoothed by smoothing circuits. When the output of the smoothing circuit reaches a predetermined value, a trigger circuit outputs a start pulse to a start terminal of a CPU. Started by the start pulse, the CPU inputs the outputs of the smoothing circuits, converts them into digital values using an A/D converter, determines integrals over 30 ms, and stores the integrals into a RAM. Then, the CPU calculates a ratio of the integral of the output of the smoothing circuit to the integral of the output of the smoothing circuit based on a program stored in a ROM. If the ratio is within a predetermined range, the CPU determines that the detected acoustic waves are the first waves of a glass breaking sound and outputs a glass breakage detection signal.

26 Claims, 22 Drawing Sheets

GLASS BREAKAGE DETECTING DEVICE

BACKGROUND OF THE INVENTION

1. Field of the Invention

The present invention relates to a glass breakage detecting device for use in, for example, sensors of motor vehicle theft deterrent systems, sensors of home security systems, and sensors of abnormality detecting systems for facilities such as factories.

2. Description of Related Art

A conventional glass breakage detecting device for use in vehicles and the like determines occurrence of glass breakage by detecting first sound waves produced at the instant the glass breaks due to impact of a hard body thereon and second sound waves produced by the scattering of glass pieces after the first wave. FIG. 11 is a graph of a typical glass breaking sound. As shown in FIG. 11, the glass breaking sound is composed of first sound waves having relatively large amplitudes and lasting only for a short duration and second sound waves having relatively small amplitudes and lasting for a long duration. Four major detecting methods or technologies using such characteristics of glass breaking sound have been disclosed.

The first technology (described in, e.g., U.S. Pat. No. 4,134,109) operates a trigger circuit in response to the first sound waves, analyzes frequencies of the second sound waves using multiple frequency filters, and determines occurrence of glass breakage depending on whether the energy level of each frequency band exceeds a predetermined level. The second technology (described in, e.g., U.S. Pat. No. 4,853,677) detects a glass breaking sound of 3–4 kHz and detects a pressure change of 1–2 Hz resulting from the opening of the glass or a door, and determines occurrence of glass breakage when both events occur. The third technology (described in, e.g., U.S. Pat. No. 4,837,558) detects a sound of 4–8 kHz using a piezoelectric element and determines that glass breakage has occurred if the signal level of the detected sound is greater than a predetermined threshold. The fourth technology (described in, e.g., Japanese Laid-Open PCT Publication No. Hei 4-500727) monitors an ultrasonic frequency band higher than 100 kHz and determines that glass breakage has occurred if the monitored energy level is greater than a predetermined threshold.

Although these technologies use different frequency ranges, they all compare a detected acoustic signal with a predetermined threshold and, if the signal level exceeds the threshold, determine that glass breakage has occurred and output an abnormality signal. However, these disclosed technologies detect breakage of glass basically depending on the magnitude of the noise level. Since frequency components of glass breaking sounds vary greatly depending on how glass actually breaks, it is difficult to set thresholds in accordance with various frequency components. Also, if the detecting device is operated while the threshold is inappropriately tuned, the accuracy of detection of glass breakage decreases.

SUMMARY OF THE INVENTION

In view of the above problems of the prior art, it is an object of the present invention to provide a glass breakage detecting device which accurately detects glass breakage independently of the intensity of acoustic waves generated therefrom, the manner of breakage of the glass, and the kind of body that impacts the glass, and which is easy to tune, considering that the relative strength of a high frequency components of first waves is an intermediate value between the relative strength of the high frequency components produced by impact of a soft body and the relative strength of the high frequency components produced by the impact of a hard body. Another object of the present invention is to provide a glass breakage detecting device that accurately detects glass breakage based on the fact that the second waves of glass breakage tend to attenuate less and tend to last longer than the first waves.

The above objects are achieved according to the present invention by providing detecting unit converts an acoustic wave into an electrical signal. A calculating unit calculates a relative strength of high frequency components of the electrical signal received from the detecting unit within a first predetermined time period beginning at a time point at which the electrical signal reaches a predetermined value. A first wave determining unit determines that the first wave has occurred if the relative strength of the high frequency components calculated by the calculating unit is within a predetermined range. The outputting unit outputs a glass breakage determination signal based on at least the determination of occurrence of the first wave made by the first wave determining unit.

Since the relative strength of high frequency components of acoustic waves is calculated, the invention is able to determine whether the sound detected by that value is the first waves of glass breaking sound or an impact sound caused by a hard or soft body as described above, thus achieving accurate detection of glass breakage sound.

The detecting unit may include a first high-pass filter that suppresses frequencies less than or equal to a first predetermined frequency and a second high-pass filter that suppresses frequencies less than or equal to a second predetermined frequency that is lower than the first predetermined frequency. The detecting unit outputs output signals from the first and second high-pass filters as first and second signals, respectively. The calculating unit calculates the relative strength of the high frequency components included in the detected sound on the basis of the first and second signals.

Although low frequency components of detected sounds vary depending on the manner of mounting the glass, the tools used for breaking glass, the manners of breaking the glass, so on, the aforementioned unit removes low frequency components using the first high-pass filter and the second high-pass filter, thus enhancing the accuracy in detection of glass breakage.

Also, the calculating unit may include a smoothing unit for smoothing the first and second signals by rectification, and calculates the relative strength of the high frequency components occurring within the first predetermined time period on the basis of the first and second signals smoothed by the smoothing unit. In this way, the system is able to remove high frequency noise from the detected sounds, thereby performing detection of glass breakage with a high accuracy.

It is additionally possible that the calculating unit comprises attenuation amount calculating unit for calculating an extent of attenuation of an acoustic wave, and the first wave determining unit determines occurrence of the first wave in accordance with the extent of attenuation calculated by the attenuation amount calculating unit, provided that the relative strength of the high frequency components is within the predetermined range. Since it is known that the first waves of glass breaking sounds exhibit a particular attenuation characteristic within a predetermined time period, the glass breakage detecting precision can be further improved by detecting the first waves of a glass breaking sound on the basis of the extent of attenuation of the acoustic waves and the relative strength of the high frequency components.

The system may include a second wave determining unit determining occurrence of the second wave if an extent of the electrical signal exceeding a predetermined threshold reaches a predetermined value within a third predetermined time period after the first wave determining unit has determined occurrence of the first wave. In this case, the outputting unit outputs the determination signal based on determination of occurrence of the first wave made by the first wave determining unit and determination of occurrence of the second wave made by the second wave determining unit. Since a portion of the electrical signal exceeding the predetermined threshold is measured, the system is able to efficiently detect the second waves of glass breaking sounds having a characteristic that the second waves last for a longer duration that the first waves, and have a repetition of rapidly attenuating waveform. The glass breakage detecting precision can be further improved by determining occurrence of glass breakage based on the detection of the second waves.

If the first wave is detected by the first wave determining unit during the third predetermined time period, it is possible that the correcting unit corrects an extent of the electrical signal exceeding a predetermined threshold by subtracting therefrom a predetermined amount. If impact sounds are continually produced by mischievous intention or the like, the determination of the first impact sound as the first waves will be followed by determination that the second impact sound has a similar attenuation characteristic as the first waves, and the extent of the electrical signal exceeding the predetermined threshold is corrected by subtracting therefrom a predetermined amount. Thus, the system avoids determining an impact sound as the second waves as in a case of mischief, and enhances the accuracy in detection of glass breakage.

Other objects and features of the present invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

Although prior art systems convert acoustic waves into electrical signals and determine occurrence of glass breakage depending on whether the signal level of a specific frequency component reaches a predetermined threshold, they fail to accurately detect glass breakage. The present invention improves breakage detection accuracy by detecting the relative strength of high frequency components included in acoustic waves.

Figure 9:
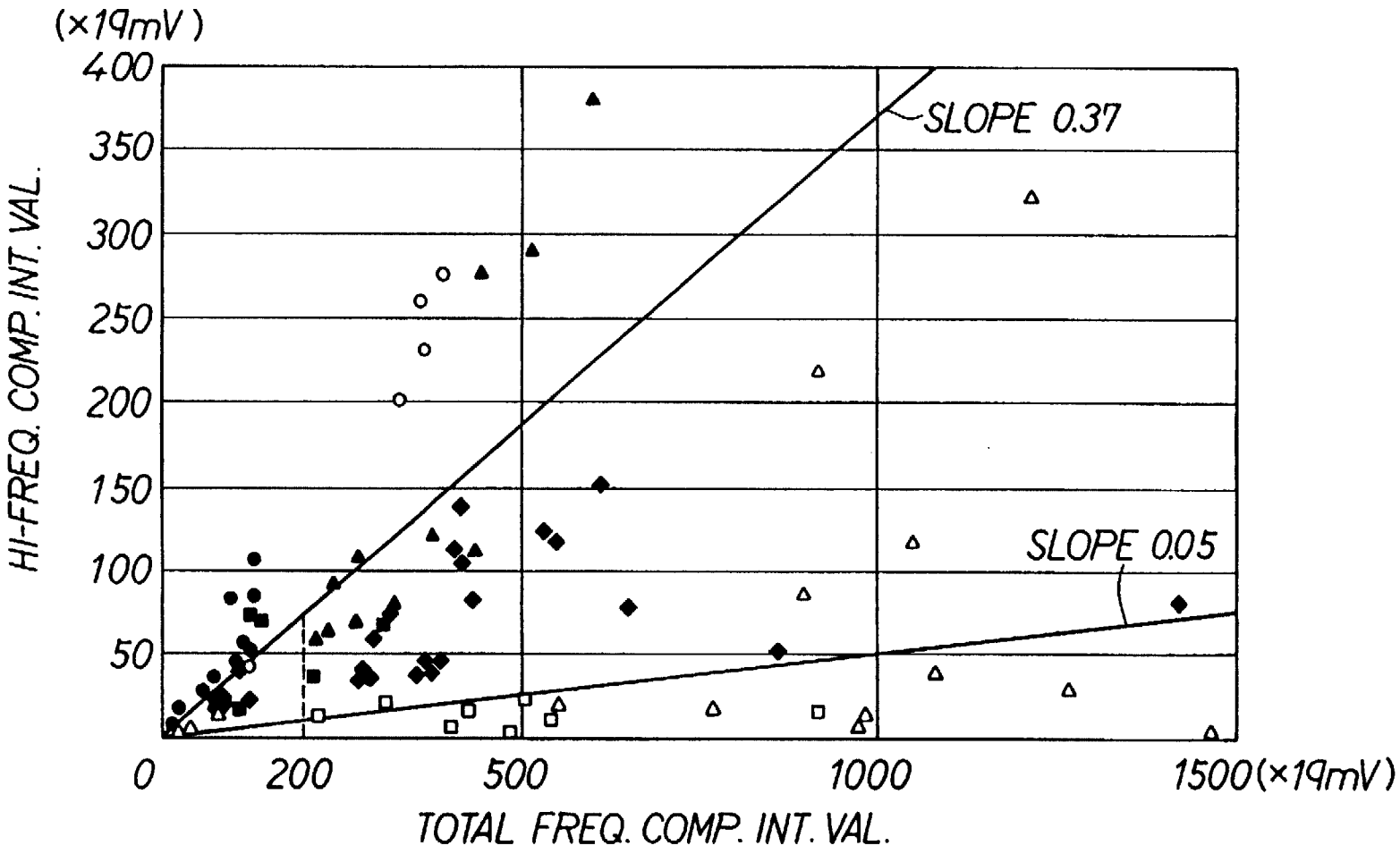
FIG. 9 is a graph showing the relationship between the integral of the full range frequency components and the integral of the high frequency components caused by a hard body impact, a soft body impact, and glass breakage (where the integral of the full range of frequency components is up to 1500)

FIG. 9 shows relative strengths of high frequency components of impact sounds caused by hard bodies, where impact of keychains is denoted by white circles, impact of coins is denoted by black circles and impact of steel balls is denoted by black triangles. The Figure also shows impact sounds caused by soft bodies (breakage due to tennis balls is denoted by white triangles and white squares), and first waves of glass breaking sounds produced by an automatic puncher or an emergency hammer. The abscissa axis in FIG. 9 shows the integral of components having a frequency of 20 Hz or higher during a 30 ms period following the time when the signal level of acoustic waves reaches a reference value. The ordinate axis shows an integral of components having a frequency of 2 kHz or higher during the aforementioned time period. The increment of each axis is 19 mV. The impact by a steel ball as shown in FIG. 9 is an impact sound caused when a steel ball of 25 cm in diameter and 65 kg in weight is dropped from a height of 70 cm in a pendulum manner. Data related to external noise are denoted by black squares in the Figure.

FIG. 9 shows the relative strength of high frequency components included in acoustic waves, by a ratio of the high frequency components to the entire range of frequency components. That is, a steeper gradient means a greater degree of the relative strength of the high frequency components, and a shallow gradient means a smaller relative strength of the high frequency components.

Although the presence of the high frequency components and all frequency components detected change according to the sensitivity of microphone used and the gain of the amplifier used in the device, the impact sounds caused by hard bodies tend to have high proportions of high frequency components, and the impact sounds caused by soft bodies tend to have low proportions of high frequency components. The glass breaking sounds tend to have proportions of the high frequency components intermediate between these high and low proportions.

As shown in FIG. 9, in hard body impact sounds, the ratio of the integral of high frequency components to the integral of all frequency components is above 0.37. In soft body impact sounds, the ratio of the integral of high frequency components to the integral of all frequency components is below 0.05. In the glass breaking sounds, the ratio of the integral of high frequency components to the integral of all frequency components is within a range of 0.05–0.37.

Figure 10:
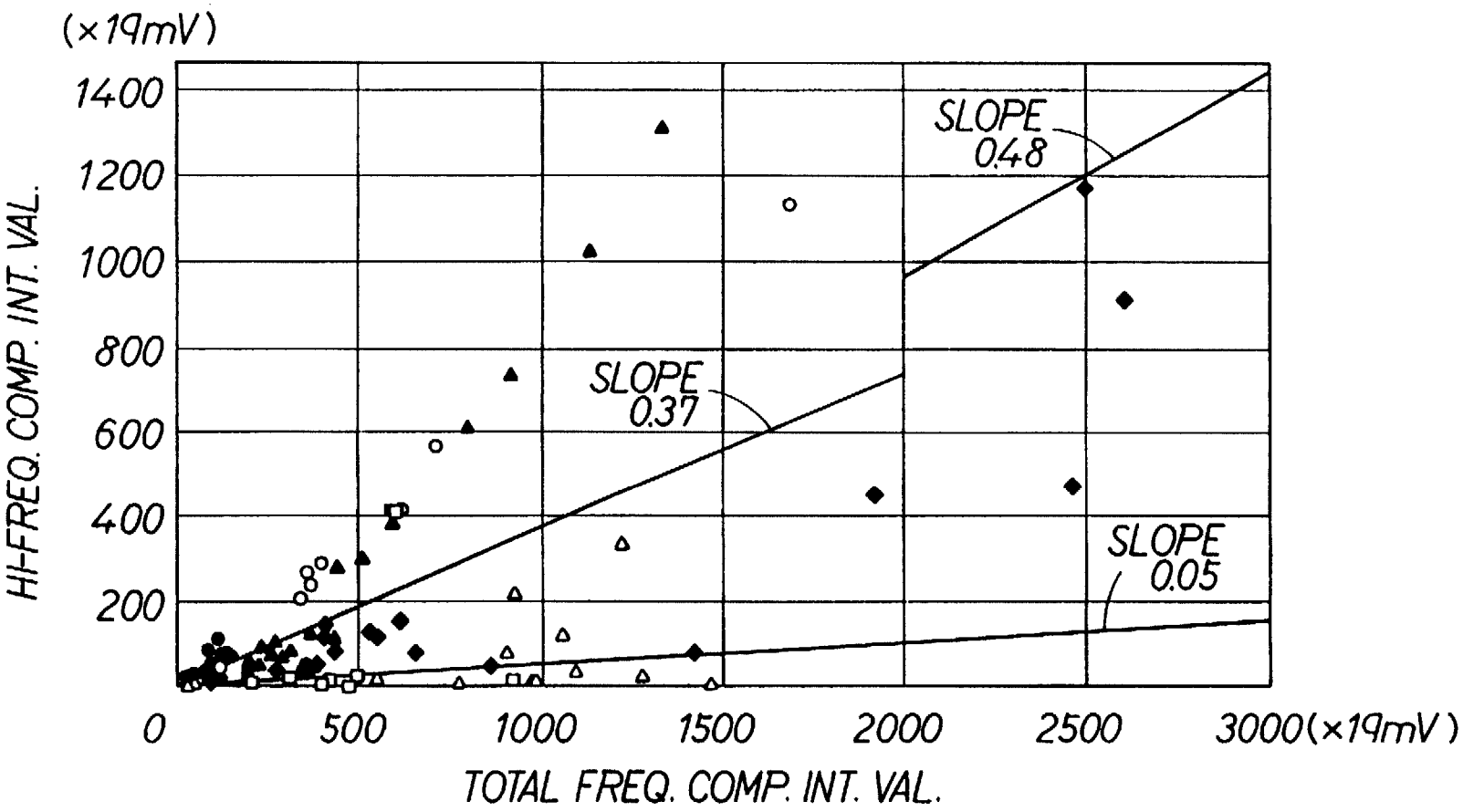
FIG. 10 is a graph showing the relationship between the integral of the full range of frequency components and the integral of the high frequency components caused by a hard body impact, a soft body impact, and glass breakage (where the integral of the full range of frequency components is up to 3000)

FIG. 10 shows data in a case where the integral of all frequency components exceeds 2000 (×19 mV). In this case, the ratio of the integral of the high frequency components to the integral of all frequency components is within a range of 0.05–0.48.

That is, in a case where the integral of the entire range of frequency components is less than or equal to 2000 (×19 mV), occurrence of glass breakage is determined if the ratio of the integral of high frequency components to the integral of all frequency components is within the range of 0.05–0.37. In a case where the integral of all frequency components exceeds 2000 (×19 mV), occurrence of glass breakage is determined if the ratio of the integral of high frequency components to the integral of all frequency components is within the range of 0.05–0.48. This manner of determination enables accurate detection of glass breakage.

Figure 13A:
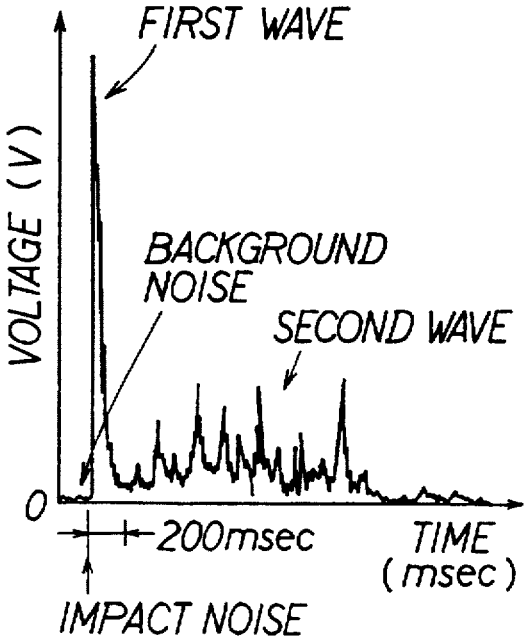
FIGS. 13A and 13B show waveforms over time after the absolute value processing of a glass breaking sound and a non-breaking sound.
Figure 13B:
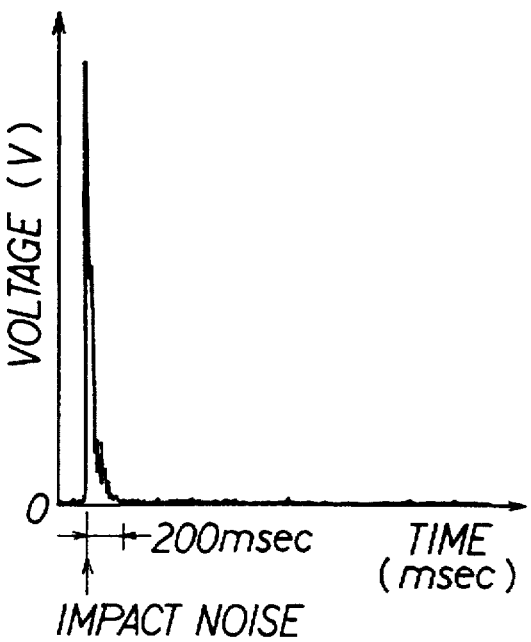
Figure 25:
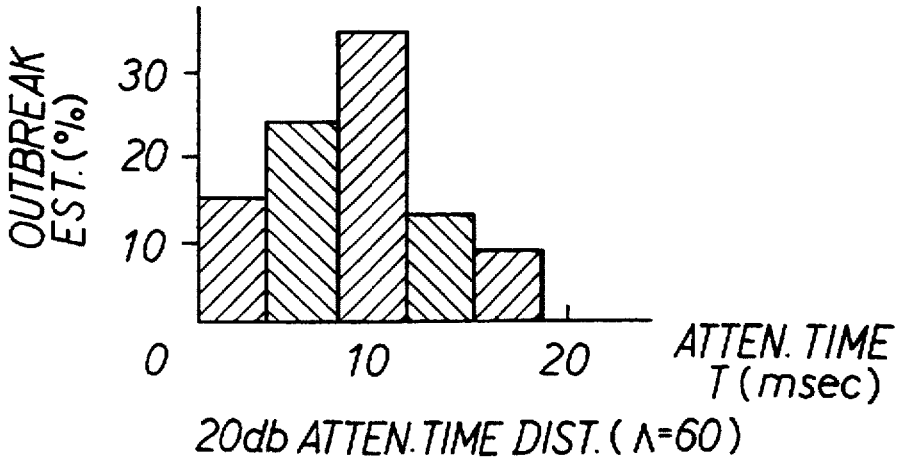
FIG. 25 shows the distribution of the attenuating times of the first waves of glass breaking sounds.

In addition, the glass breaking sounds have attenuation characteristics different from those of acoustic waves caused by impacts alone. FIGS. 13A and 13B show waveforms of a glass breaking sound and a non-breaking sound by impact where all the values are converted into absolute values. Looking at the impact alone, a silent state is resumed about 200 ms after the impact. When glass is actually broken, sounds are continuously produced even after 200 ms. The sounds preceding the time point of 200 ms are the first waves, and the continuous sounds after 200 ms are the second waves. FIG. 25 shows the distribution (sample number=60) of sound wave attenuation at 20 dB (=1/10) determined by comparison of the initial peak values of the first waves of glass breaking sounds with subsequent peak values. As indicated, the glass breaking sounds have attenuation waveforms where a 20 dB attenuation occurs about 20 ms after occurrence of the first waves.

As indicated in FIG. 13A, the second waves include a waveform in which relatively large peaks occur several times and a rapid attenuation follows each of the peak values, and a waveform which gradually attenuates. Since the gradually attenuating waveform lasts longer than the rapidly attenuating waveform, the second waves exhibit gradually attenuating characteristics where attenuation gradually occurs. Therefore, the presence of second waves can be determined by detecting gradually attenuating waveforms while ignoring rapidly attenuating waveforms.

Figure 24:
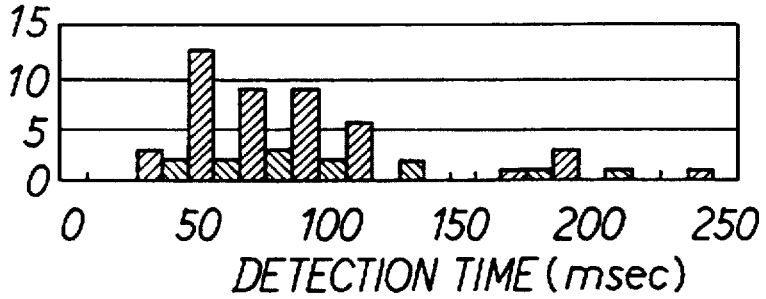
FIG. 24 shows the distribution of detection times for slowly attenuating portions of the second waves of a glass breaking sound.

FIG. 24 shows the distribution (sample number=58) of detection time of only gradually attenuating waveforms. It should be understood that even if the duration of the rapidly attenuating waveform portion is subtracted from the duration of all second waves, there is a sufficiently long time for detection of the second waves.

Thus, glass breaking sounds and impact sounds can be discriminated using the attenuation characteristics of electrical signals that occur after the first waves have sufficiently attenuated (i.e., 200 ms) after detection of the first waves.

Figure 1:
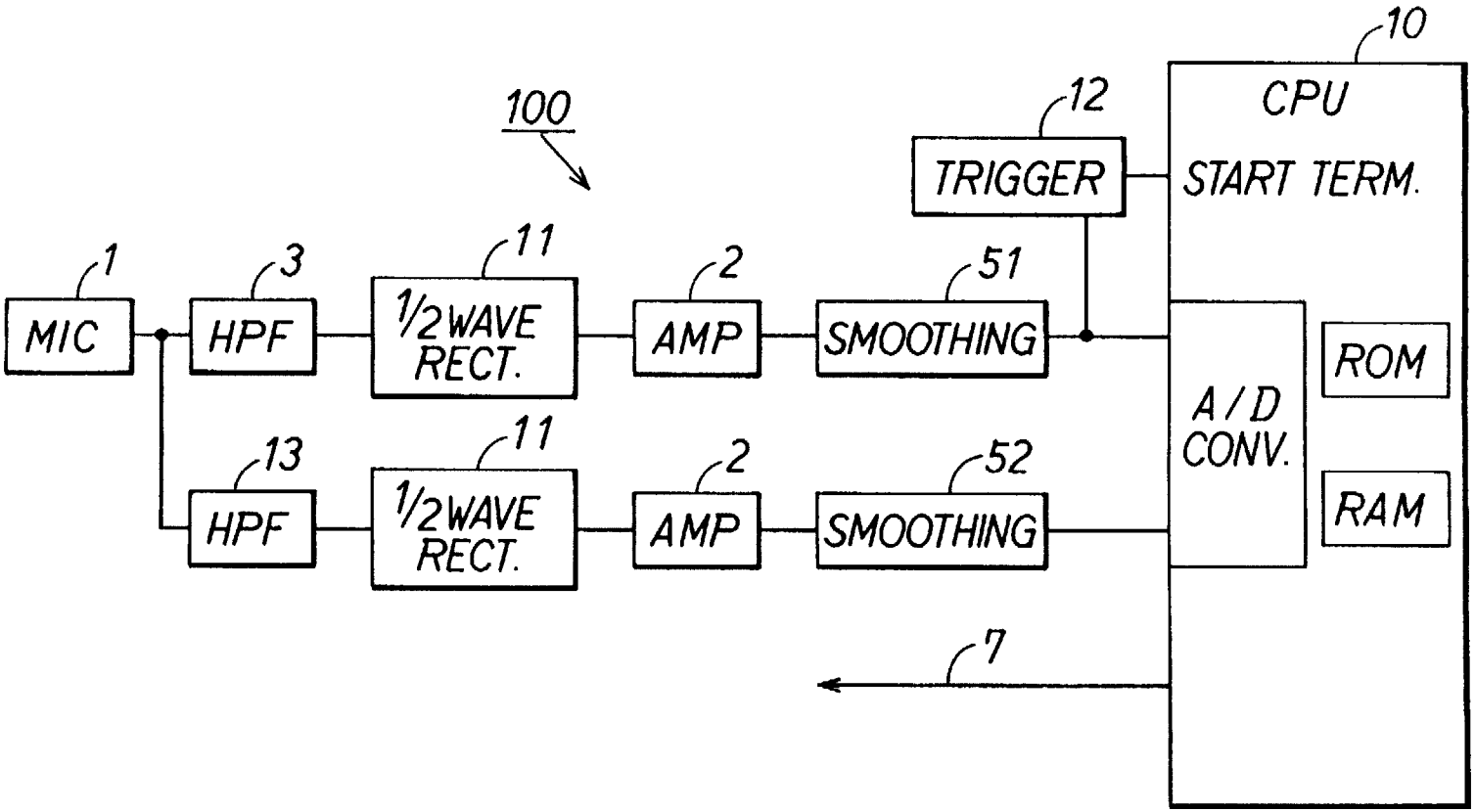
FIG. 1 is a block diagram of a first preferred embodiment of the present invention.

Specific embodiments of the present invention will now be described. FIG. 1 is a block of a first embodiment of the present invention. Here, a microphone 1 of a glass breakage detecting device 100 detects glass breaking sounds and converts the glass breaking sounds into electrical signals in accordance with the magnitudes of the sounds.

A high-pass filter 3 (corresponding to the first high-pass filter in the appended claims) removes components having frequencies less than or equal to 2 kHz (corresponding to the first frequency), from the output signals from the microphone 1, and extracts only components having greater than or equal to 2 kHz (hereinafter, referred to as "high frequency components").

A high-pass filter 13 (corresponding to the second high-pass filter) removes components having frequencies less than or equal to 150 kHz (corresponding to the second frequency) from the output signals from the microphone 1, and extracts only components having frequencies greater than 150 kHz (hereinafter, referred to as "all frequency components"). The operation of the high-pass filter 13 eliminates variations of low frequency components that are dependent on the manner of glass mounting, the tools used for breaking the glass, how the glass is broken, and so on. Similarly, the high-pass filter 3 also eliminates variations of low frequency components. The high-pass filters 3 and 13 and the microphone 1 correspond to the detecting means. The output from the HPF 3 and the output from the high-pass filter 13 correspond to the first and second signals, respectively.

Both of the high-pass filters 3 and 13 are followed by a half-wave rectifier circuit 11 and an amplifier 2. The half-wave rectifier circuits 11 and the amplifiers 2 rectify and then amplify the high frequency components and all frequency components, and then output to smoothing circuits 51 and 52. The amplifiers 2 need only have gains commensurate with the characteristics of the microphone 1, and may be omitted if not needed. The half-wave rectifiers 11 and the smoothing circuits 51 and 52 correspond to the smoothing means in the appended claims.

The smoothing circuits 51 and 52 smooth the outputs from the amplifiers 2, and provide a smoothed output thereof to an A/D converter of a CPU 10 (corresponding to the calculating means, the first wave determining means, and the output means). The output from the smoothing circuit 51 is also inputted to a trigger circuit 12. The trigger circuit 12 outputs a start pulse to a start terminal of the CPU 10 to start the CPU 10 only when the output of the smoothing circuit 51 reaches a predetermined value.

The CPU 10 is started in response to the start pulse from the trigger circuit 12. The CPU 10 then converts the output (a smoothed value of the high frequency components) from the smoothing circuit 51 and the output (a smoothed value of the integral of all frequency components) from the smoothing circuit 52 into digital signals using the A/D converter, and calculates integrals during a predetermined time period. The CPU 10 stores the integrals into a RAM. When the ratio of the integral of the high frequency components to the integral of all frequency components (corresponding to the relative strength) is within a predetermined range, the CPU 10 determines that the first waves of a glass breaking sound have occurred, and outputs a glass breakage detection signal 7 (corresponding to the determination signal) through software processing based on a program stored in a ROM.

Figure 2:
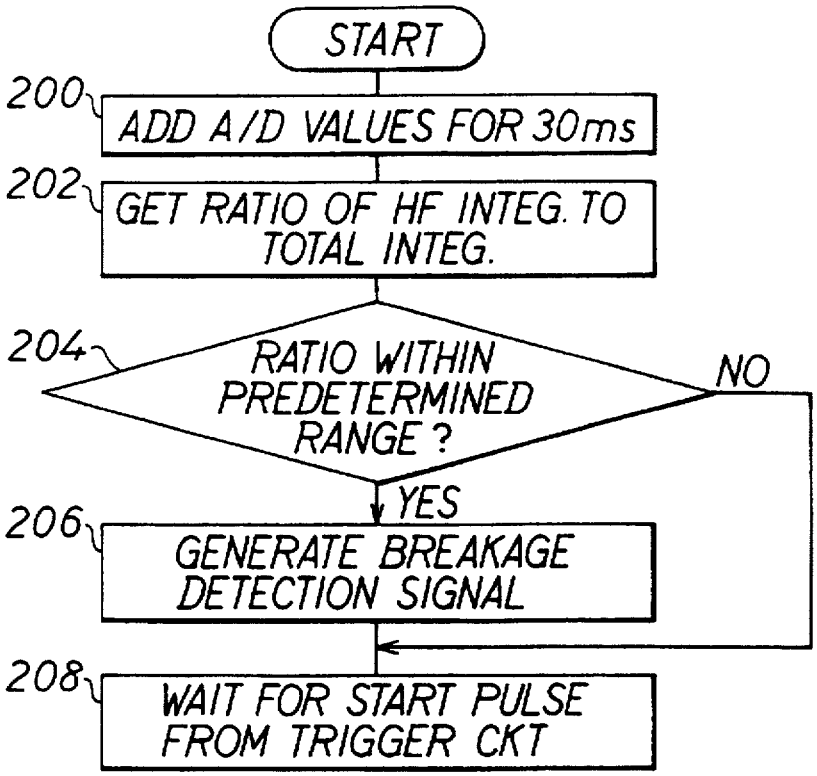
FIG. 2 is a flowchart showing the processing flow of the glass breakage determination according to the first.

The flow of operation of the CPU 10 of the glass breakage detecting device 100 having the aforementioned construction will be described with reference to FIG. 2.

When the output signal from the smoothing circuit 51 reaches a predetermined value, the trigger circuit 12 starts to output a start pulse to the start terminal of the CPU 10. The CPU 10 is thereby started. The CPU 10 converts the output signals from the smoothing circuits 51, 52 into digital values and adds the values up for 30 ms (corresponding to the first predetermined time period) (Step 200). The integrals of the output signals from the smoothing circuits 51, 52 are thus calculated. Although the adding time period is set to 30 ms, the time period may be set to any time length when the first waves of a glass breaking sound continue, that is, any value within a range of 20–50 ms.

Then the CPU 10 calculates a ratio of the integral of the outputs from the smoothing circuit 51 to the integral of the outputs from the smoothing circuit 52 (Step 202). This calculation determines the ratio of the integral of the high frequency components to the integral of all frequency components. The processing up to Step 202 corresponds to the calculating means.

Subsequently, the CPU 10 determines whether the ratio of the integral of high frequency components to the integral of all frequency components calculated in Step 202 is within a prescribed range (Step 204). More specifically, if the ratio is in a range of $0.05 \leqq$ the ratio $\leqq 0.37$ in a case where the integral of all frequency components is equal to or less than 2000 (×19 mV), the CPU 10 determines that the detected acoustic waves are the first waves of a glass breaking sound, and outputs the glass breakage detection signal 7 (Step 206), and then waits for a start pulse from the trigger circuit 12 (Step 208).

If the ratio is within a range of $0.05 \leqq$ the ratio $\leqq 0.48$ in a case where the integral of all frequency components is greater than 2000 (×19 mV), Step 204 determines that the detected acoustic waves are the first waves of a glass breaking sound. Then the CPU 10 outputs the glass breakage detection signal 7 and waits for a start pulse. The processing in Step 204 corresponds to the first wave determining means, and the processing in Step 206 corresponds to a determining means.

If the ratio of the integral of high frequency components to the integral of all frequency components is outside the aforementioned ranges, the CPU 10 determines that the detected acoustic waves do not result from a glass breaking sound but result from an impact sound caused by striking with a hard body or a soft body. Then the CPU 10 reaches the start pulse waiting state (Step 208) without outputting the glass breakage detection signal 7.

Since the prior art system detect first waves of a glass breaking sound based on whether the signal level of a particular frequency component reaches a predetermined value, the glass breakage detecting accuracy in those systems is low. In contrast, since the above-described construction determines occurrence of first waves based on of the relative strength of the high frequency components of the detected acoustic waves, the embodiment is able to detect glass breakage with high accuracy independently of the magnitude of the signal level of acoustic waves.

That is, the embodiment clearly determines whether the detected acoustic waves are the first waves of a glass breaking sound based on whether the ratio of the integral of high frequency components to the integral of all frequency components occurring within the predetermined time period (30 ms) after the signal level has reached a predetermined value (that is, after the trigger circuit 12 has outputted a start pulse) is within the prescribed ranges.

The trigger circuit 12 generates the start pulse only when the microphone 1 receives acoustic waves having a signal level equal to or greater than a predetermined level. Since the CPU 10 remains unstarted if the sound reaching the microphone 1 does not reach a predetermined value, the embodiment requires only intermittent usage of the CPU 10, thus reducing power consumption.

Although the embodiment detects a glass breakage on the basis of the ratio of the integral of high frequency components to the integral of all frequency components, the criterion for determining occurrence of a glass breakage is not limited to the aforementioned ratio. For example, the relative strength of the high frequency components included in the detected acoustic waves may be indicated by an integral of the ratio of the high frequency components to the integral of all frequency components, a ratio of the effective value of power of the high frequency components to the effective value of power of the entire range of frequency components, a ratio of the mean of the rectified high frequency components to the mean of the rectified entire range of frequency components, or a ratio of the integral of high frequency components to the integral of the low frequency components (equal to or less than 2 kHz).

Although this embodiment generates a start pulse based on the signal level occurring after processing by the high-pass filter 3, it may be constructed so that the start pulse is generated on the basis of the signal level prior to processing by the high-pass filter 3. However, since glass breaking sounds normally include high frequency components, the construction that generates a start pulse on the basis of the signal level after the HPF 3 is able to more precisely generate a start pulse when a glass breakage sound occurs. The embodiment is adjusted so that the trigger circuit 12 generates a start pulse if the output signal from the microphone 1 is equal to or greater than 5 mV.

Figure 8A:
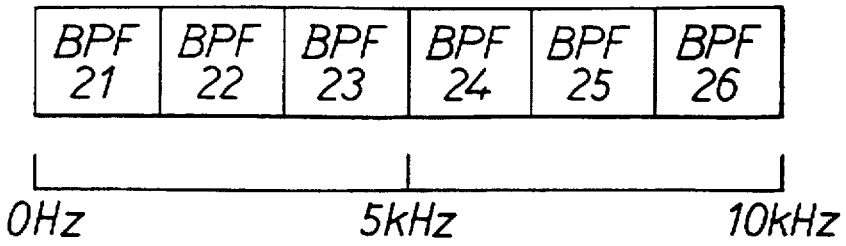
FIGS. 8A–8B illustrate calculation of a frequency component ratio where more than two band-pass filters are provided.
Figure 8B:
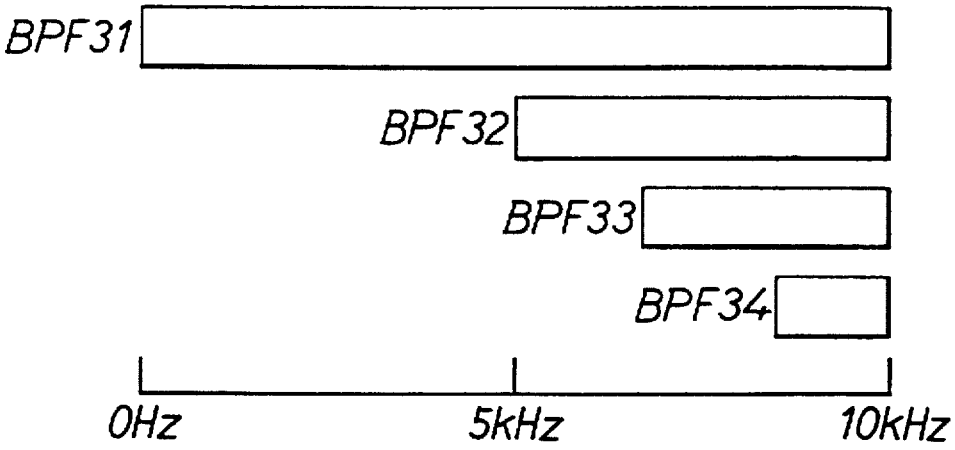
Figure 11:
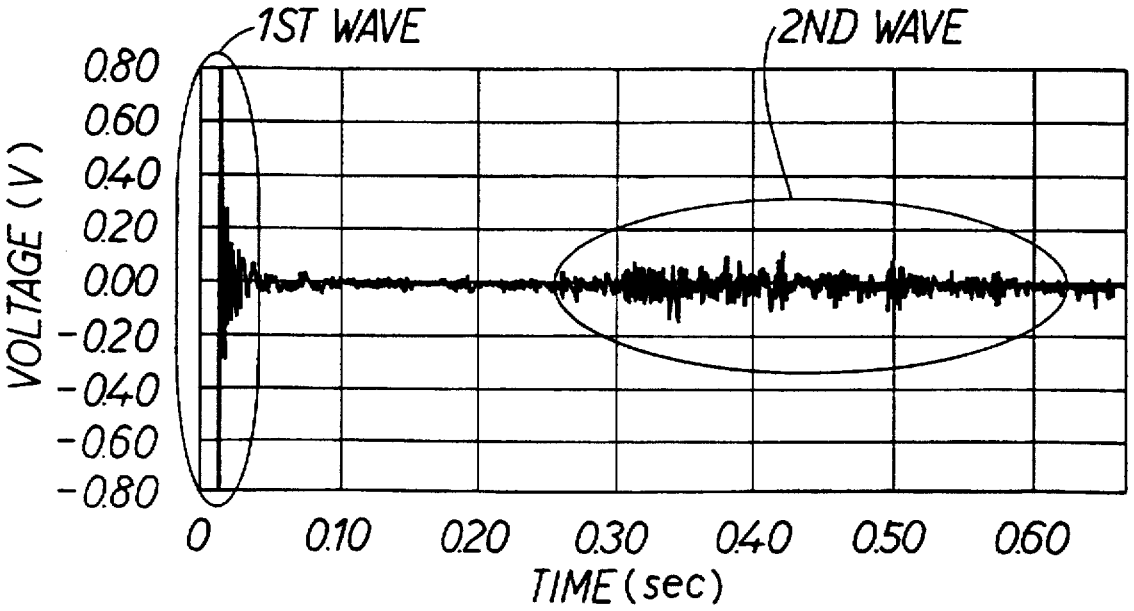
FIG. 11 shows a waveform over time of a representative glass breaking sound.

Although the glass breakage detecting device 100 employs the high-pass filters 3 and 13, the glass breakage detecting device 100 may employ low-pass filters or band-pass filters as long as the ratio of the high frequency components can be measured. For example, as shown in FIG. 8A, multiple (six in FIG. 8A) band-pass filters 21–26 with the pass bands differing from one another may be used to determine the ratio of the high frequency components. As shown in FIG. 8B, a plurality (four in FIG. 8B) of band pass filters 31–34 with the pass bands being different from one another may be employed, and the high frequency components may be weighted to determine the appropriate ratio. If many filters are employed as described above, it is necessary to measure an actual glass breaking sound in accordance with the frequency bands to be used and to set a range of the ratio of the high frequency components for detection of glass breakage.

In addition, although the high pass filters 3 and 13 are followed by the half-wave rectifier circuits 11 for conversion to absolute values and the output signals from the smoothing circuits 51 and 52 are detected, full-wave rectifier circuits may be provided instead of the half-wave rectifier circuits 11. The provision of full-wave rectifier circuits may improve the acoustic wave detection precision.

The smoothing circuits 51 and 52 may be smoothing filters employing passive elements. The smoothing circuits 51, 52 may also be combined with the half-wave rectifier circuits 11 and the amplifiers 2 into a unit by using an envelope detector circuit or the like.

Figure 3:
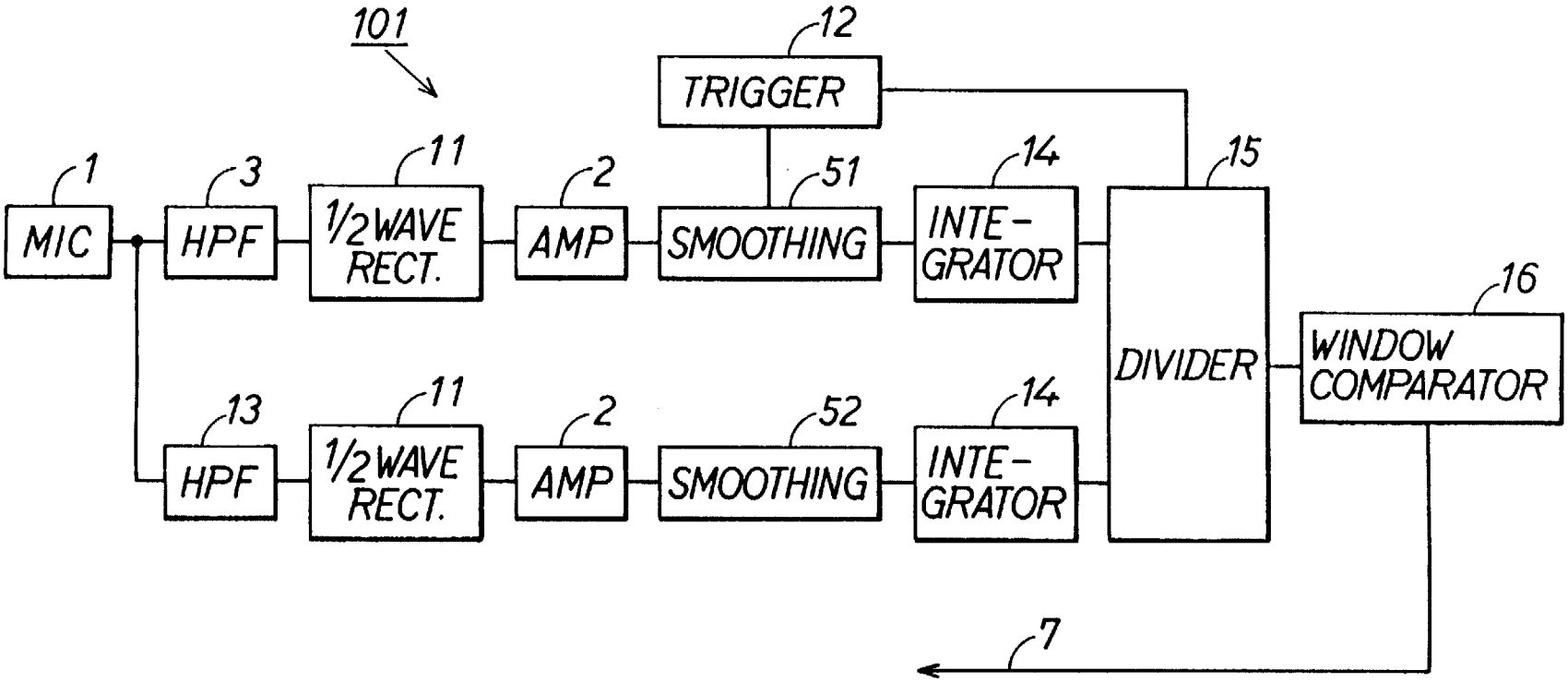
FIG. 3 is a block diagram of a modification of the first embodiment.

Although the above embodiment determines occurrence of glass breakage though the processing of the CPU 10, other circuit constructions may also be employed. For example, in FIG. 3, the CPU 10 is replaced with integrators 14, a divider circuit 15, and a window comparator 16 in order to achieve substantially the same performance as achieved by the system shown in FIG. 1. As shown in FIG. 3, the integrators 14 integrate the outputs from the smoothing circuits 51 and 52 for 30 ms. When the output from the smoothing circuit 51 reaches a predetermined value, the trigger circuit 12 outputs a start pulse to the divider circuit 15.

The start pulse starts the divider circuit 15 and starts the integrators to calculate a ratio of the output of the integrator 14 connected to the smoothing circuit 51 to the output of the integrator 14 connected to the smoothing circuit 52 occurring during 30 ms. The window comparator 16 receives the signal from the divider circuit 15 and determines whether the voltage level of the input signal is within a prescribed range. If the input signal is within the prescribed range, the window comparator 16 determines that the detected acoustic waves are the first waves of a glass breaking sound and outputs the glass breakage detection signal 7. The window comparator 16 may be formed by using two comparators. In this construction, the integrators 14 and the divider circuit 15 correspond to the calculating means, and the window comparator 16 corresponds to the first determining means and the output means.

This construction will achieve substantially the same advantages as achieved by the glass breakage detecting device 100 shown in FIG. 1.

(Second Embodiment)

Figure 4:
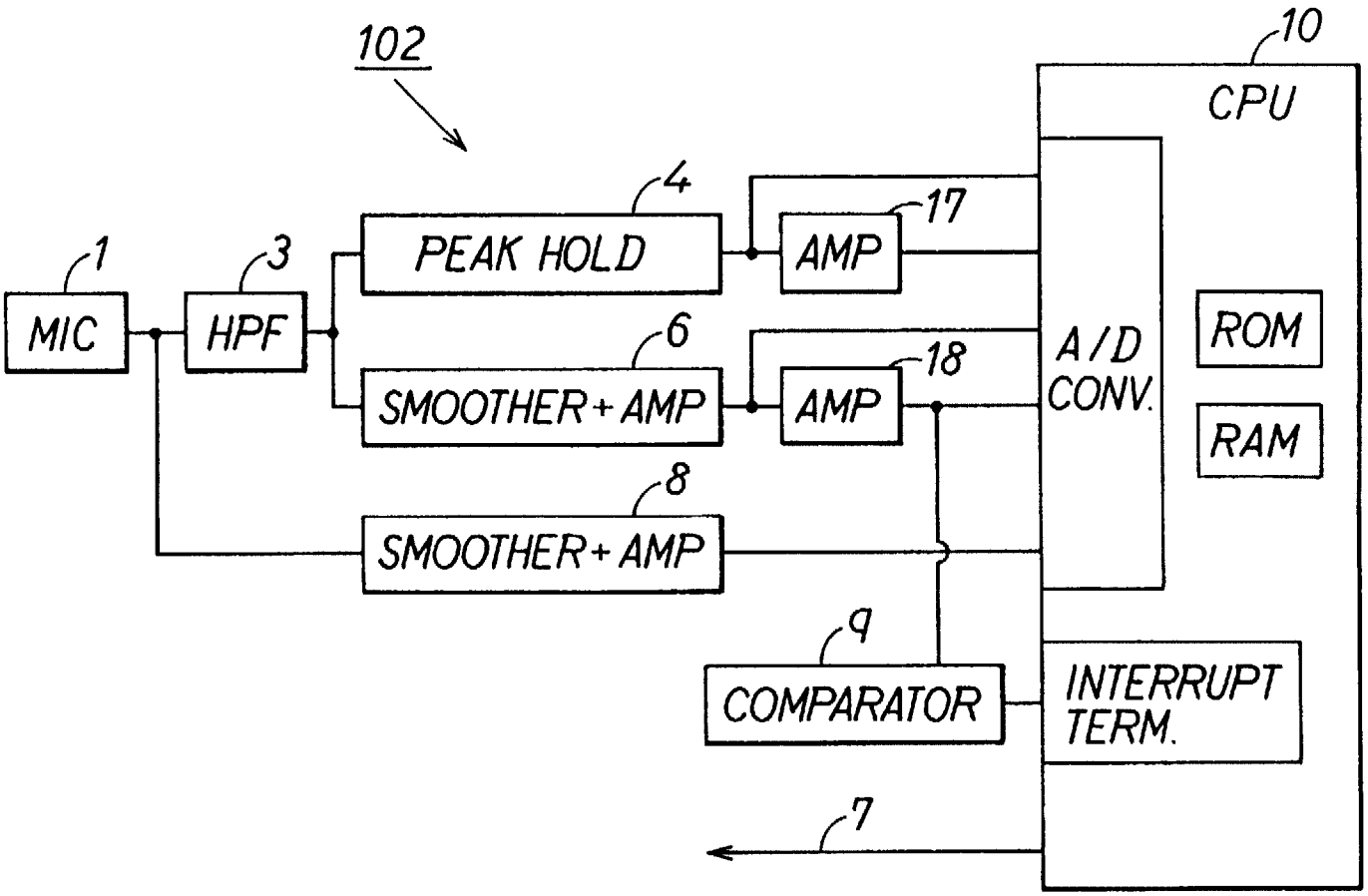
FIG. 4 is a block diagram of a second preferred embodiment of the present invention.

FIG. 4 is a block diagram showing a glass breakage detecting device 102 according to a second preferred embodiment of the present invention. The microphone 1, the high-pass filter 3 and the CPU 10 of the glass breakage detecting device 102 are constructed in the same manner as in the first embodiment. The microphone 1 and the high-pass filter 3 correspond to the detecting means.

The high-pass filter 3 is followed by a parallel circuit of a peak hold circuit 4 (corresponding to the maximum peak value detecting means) and a smoothing circuit 6 (corresponding to the smoothing means) including a rectifier circuit. The peak hold circuit 4 holds the maximum peak value of zero-to-peak of the output signal of the high-pass filter 3, and the smoothing circuit 6 rectifies the output signal from the high-pass filter 3 and smoothes it, thus providing a high range smooth output.

The peak hold circuit 4 and the smoothing circuit 6 are followed by amplifiers 17 and 18, respectively. The amplifiers 17 and 18 amplifies the outputs from the peak hold circuit 4 and the smoothing circuit 6 and sends the amplified outputs to the A/D converter of the CPU 10. The A/D converter of the CPU 10 also receives the output signals of the peak hold circuit 4 and the smoothing circuit 6 directly without amplification by the amplifiers 17 and 18. The amplifiers 17 and 18 need only have a gain commensurate with the characteristics of the microphone 1, and may be omitted if they are not necessary.

The output signal of the amplifier 18 is also sent to an comparator 9. The comparator 9 receives the output signal of the amplifier 18 and, if the signal level reaches a predetermined value, provides a start signal (Hi level) to an interrupt terminal of the CPU 10 to start the CPU 10. Since the comparator 9 generates a start signal only when the microphone 1 receives acoustic waves having a signal level equal to or higher than a predetermined level, the CPU 10 remains unstarted if the acoustic waves inputted to the microphone 1 do not reach the predetermined level. This embodiment thus makes only intermittent use of the CPU 10 and reduces power consumption.

The output signal of the microphone 1 is also sent to the smoothing circuit 8 (corresponding to the smoothing means) as well as the high-pass filter 3. The smoothing circuit 8 receives the output signal of the microphone 1 without intervention by the high-pass filter 3, and smoothes the signal to provide a full range smooth output. The full range smooth output is sent to the A/D converter of the CPU 10.

The CPU 10 is started by the start signal from the comparator 9 and converts the high range smooth output and the full range smooth output into digital signals using the A/D converter. The CPU 10 stores the digital values in a RAM. The CPU 10 determines that the first waves and second waves of a glass breaking sound have occurred, and outputs a glass breakage detection signal 7 (corresponding to the determination signal) through software processing (described below) based on a program stored in a ROM.

Figure 5:
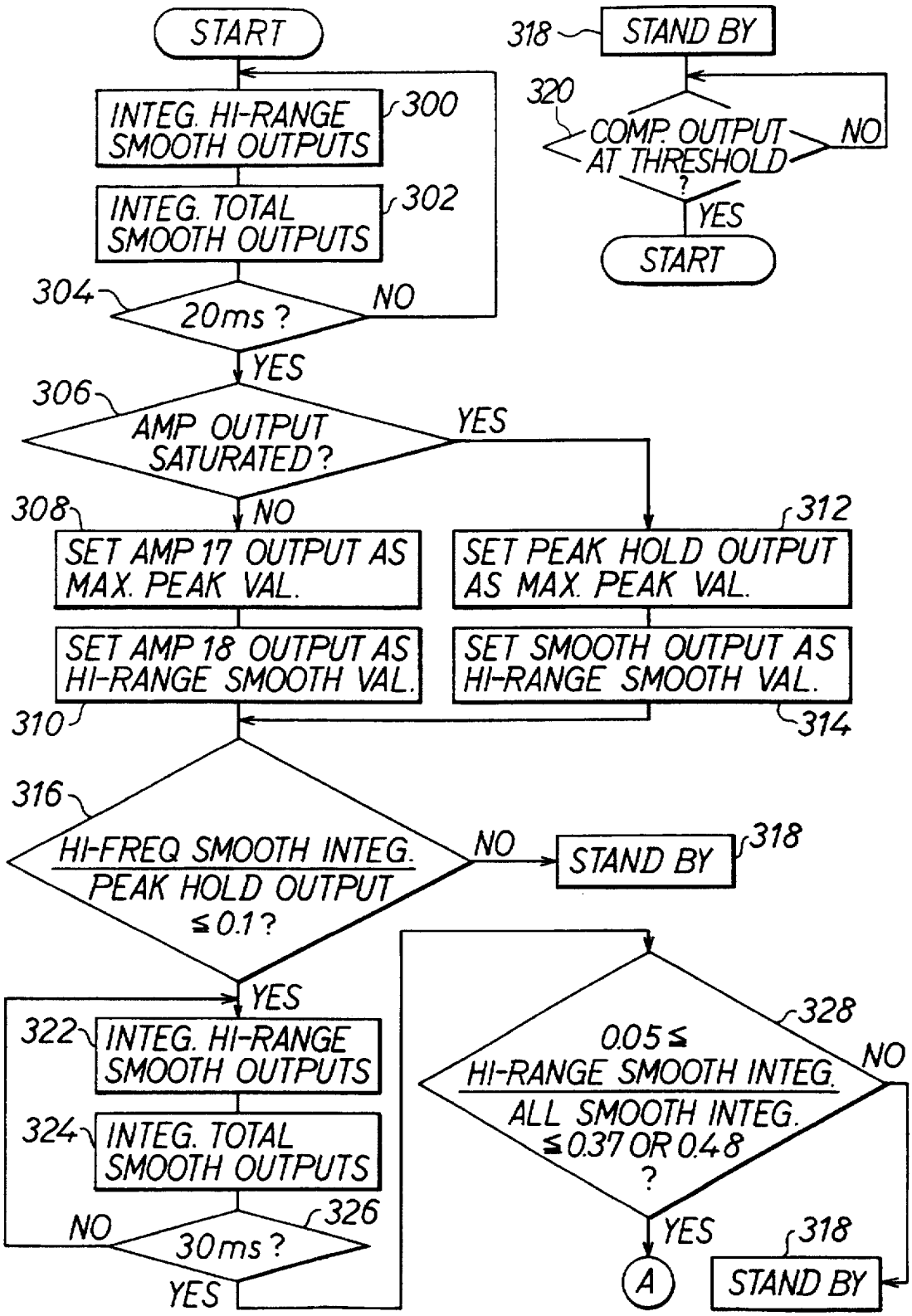
FIG. 5 is a flowchart showing the processing flow of the glass breakage determination according to the second embodiment.

The flow of the processing of the CPU 10 of the glass breakage detecting device 102 constructed as described above will be described with reference to FIGS. 5 and 6.

When the output signal of the amplifier 18 reaches the predetermined level, the comparator 9 outputs the start signal to the interrupt terminal of the CPU 10. Upon receipt of the start signal, the CPU 10 starts and integrates the high range smooth outputs from the smoothing circuit 6 and the amplifier 18 for 20 ms (corresponding to the second predetermined time period) (Step 300), and also integrates the full range smooth output from the smoothing circuit 8 for 20 ms (Step 302).

When 20 ms elapses, Step 304 makes an affirmative determination. Step 306 then determines whether the output of the amplifier 17 is saturated. If the output of the amplifier 17 is not saturated, the CPU 10 takes up the output of the amplifier 17 as a maximum peak value (Step 308), and takes up the output of the amplifier 18 as a high range smooth output (Step 310).

If Step 306 determines that the output of the amplifier 17 is saturated, the CPU 10 directly takes up the output of the peak hold circuit 4 as a maximum peak value (Step 312), and directly takes up the output of the smoothing circuit 6 as a high range smooth output (Step 314).

The A/D converter of the CPU 10 according to this embodiment is of the 8-bit type and has a resolution of 19 mv, and the output signal from the microphone 1 caused by a glass breaking sound is within a range of 10 mV to 2 V. Therefore, a single amplifier gain will make it difficult to precisely measure the attenuation ratio when the amplifier is saturated. This difficulty is eliminated by the processing from Step 306 to Step 314. That is, if the output of the amplifier 17 is greater than the saturation voltage, the CPU 10 reads a signal preceding the amplifier 17 in order to avoid a precision decrease due to saturation of output.

Then the CPU 10 calculates a ratio (corresponding to the relative level) of the high range smooth output to the thus-obtained maximum peak value (corresponding to the relative level calculating means), and determines whether the ratio is equal to or less than 0.1 (corresponding to the predetermined level) (Step 316). This is to determine whether the detected acoustic waves have substantially the same attenuation characteristics as the first waves of a glass breaking sound. If the value of the ratio of the high range smooth output to the maximum peak value is greater than 0.1, which means that the detected acoustic waves are not the first waves of a glass breaking sound, then the CPU 10 enters a standby mode (Step 318), and restarts processing when the signal level into the comparator 9 reaches the predetermined value (Step 320).

If the ratio of the high range smooth output to the maximum peak value is less than or equal to 0.1, it is determined that the detected acoustic waves have substantially the same attenuation characteristics as the first waves of a glass breaking sound and there is a high possibility that the detected acoustic waves are the first waves. Then, the CPU 10 integrates the high range smooth output, that is, the output of the smoothing circuit 6, for another 10 ms (30 ms in total) (Step 322), and integrates the full range smooth output, that is, the output of the smoothing circuit 8, for the same length of time (Step 324).

When 30 ms has elapsed (Step 326), the CPU 10 calculates a ratio of the integral of the high range smooth output to the integral of the full range smooth output (corresponding to the calculating means), and determines whether the ratio is within a predetermined range (Step 328). This is to determine whether the detected acoustic waves are the first waves of a glass breaking sound or an impact sound on the basis of the relative strength of the high frequency components included in the acoustic waves.

Figure 6:
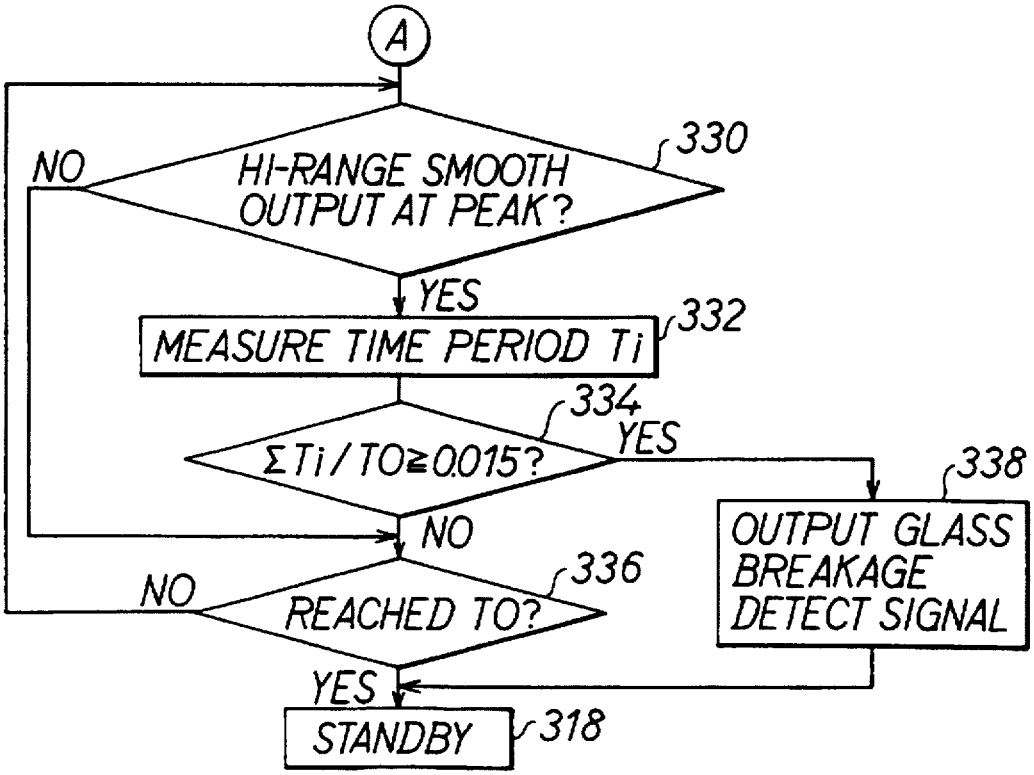
FIG. 6 is a flowchart showing the processing flow of the glass breakage determination according to the second embodiment.

If the ratio is between 0.05 and 0.37 in a case where the integral of the full range smooth output is less than or equal to 2000 (×19 mV), it is determined that the detected acoustic waves are the first waves of a glass breaking sound, and the operation proceeds to Step 330 in FIG. 6. If the ratio is between 0.05 and 0.48 in a case where the integral of the full range smooth output is greater than 2000 (×19 mV), it is determined that the detected acoustic waves are the first waves of a glass breaking sound, and the operation proceeds to Step 330 in FIG. 6.

If the ratio of the integral of the high range smooth output to the integral of the full range smooth output is not within the aforementioned ranges, it is determined that the detected acoustic waves are not the first waves but are caused by an impact sound produced by a hard body or a soft body. The CPU 10 then enters the standby mode waiting for a start signal from the comparator 9. The processing up to Step 328 corresponds to the first wave determining means.

To determine whether the detected acoustic waves include the second waves of a glass breaking sound, the CPU 10 first determines whether the high range smooth output reaches a predetermined value (corresponding to the predetermined threshold) (Step 330 in FIG. 6). This predetermined value is a fixed number set as a multiple of the background, which is set to 1.1 according to this embodiment. The background noise is the output of the smoothing circuit 51 during a period when the CPU 10 is not started. Since the fixed number may be set to any desired value, the fixed number can be set in accordance with the operating environment so that the accuracy in glass breakage detection will be improved.

If the high range smooth output reaches the predetermined value, the CPU 10 measures an accumulated time ΣTi during which the high range smooth output exceeds the predetermined value (Hi output signal from the comparator 9) within a second wave detection time period T0 (corresponding to the third predetermined time period, for example, 2000 ms) (Step 332).

If Step 330 determines that the high range smooth output does not reach the predetermined value, the operation proceeds to Step 336, where it determines whether the high range smooth output reaches the predetermined value until the second wave detection time period T0 elapses.

If the ratio of the accumulated time ΣTi to the second wave detection time T0 is equal to or greater than 0.015, it is determined that the detected acoustic waves are the second waves of a glass breaking sound (Step 334), and then the CPU 10 outputs a glass breakage detection signal 7 (Step 338). If the ratio of the accumulated time ΣTi to the second wave detection time T0 does not reach 0.015, measurement of accumulated time ΣTi is continued until the predetermined second wave detection time T0 elapses (Step 336). When the second wave detection time T0 has elapsed, the CPU 10 returns to the standby mode (Step 318). The processing to Step 334 corresponds to the second wave determining means.

Figures 7A, 7B, 7C, 7D, 7E, 7F:
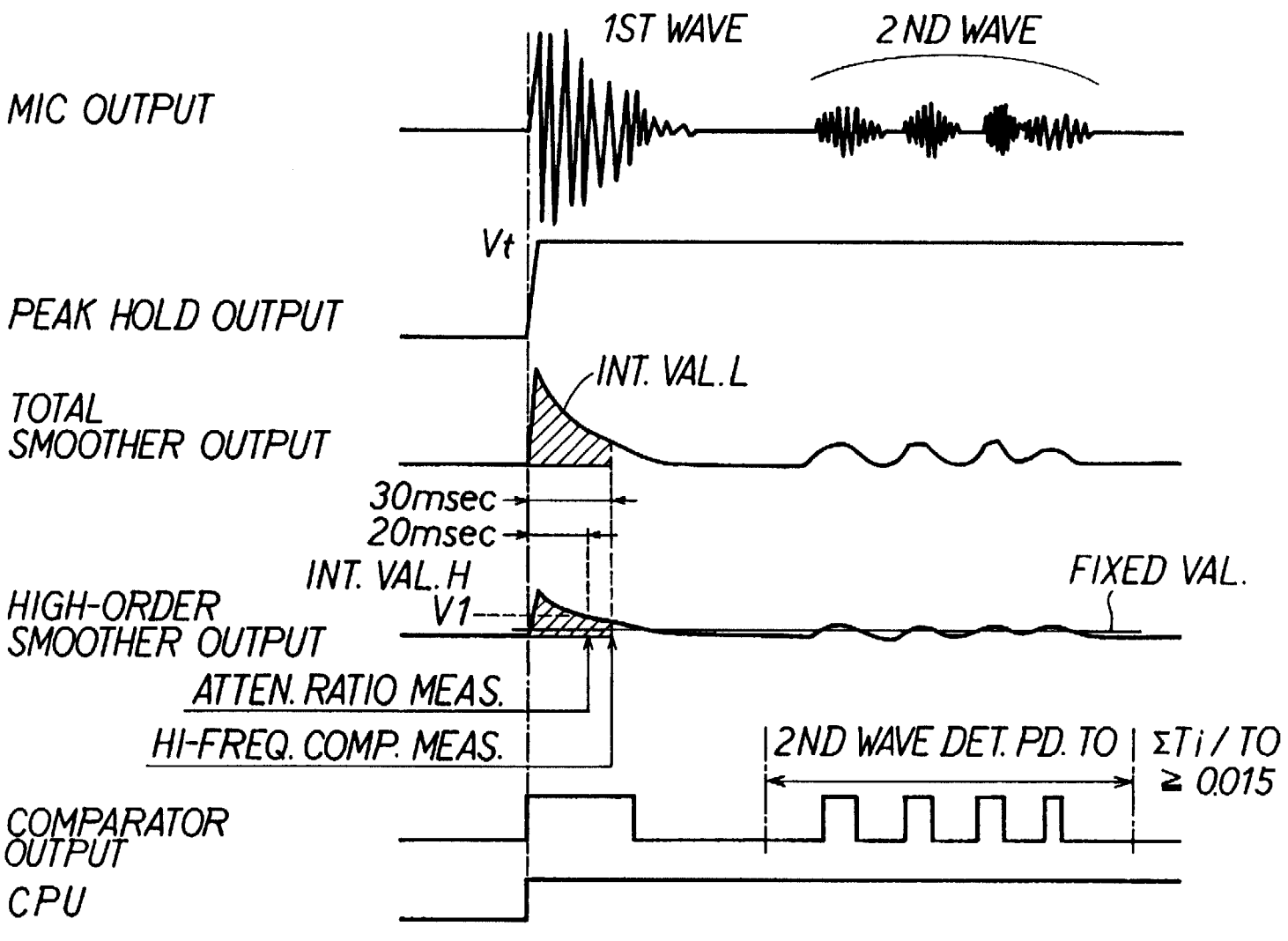
FIGS. 7A–7F are graphs showing various signals in the second embodiment.

The timing of the glass breakage detecting device 102 is shown in FIGS. 7A–7F. FIG. 7A shows the output signal of the microphone 1, where the first waves of a glass breaking sound having relatively large amplitudes and lasting for a short time are followed by second waves having relatively small amplitudes and lasting for a long duration. FIG. 7B shows the output of the peak hold circuit 4, which is held at the maximum peak value Vt of the first waves corresponding to FIG. 7A. The maximum peak value Vt is used for determination of attenuation characteristics of the first waves. FIG. 7C shows the output of the smoothing circuit 8, that is, the full range smooth output. The integral L of the output during 30 ms is used to calculate a relative strength of the high frequency components of the first waves.

FIG. 7D shows the output of the smoothing circuit 6, that is, the high range smooth output, where the output level is lower than that of the full range smooth output shown in FIG. 7C. The output value Vt occurring 20 ms after the comparator 9 has outputted a start signal is used to detect the relative level of the detected sound. More specifically, it is determined whether the ratio of the output value Vt to the maximum peak value Vt is equal to or less than 1/10 in order to correspondingly determine whether the detected sound includes substantially the same relative level as the first waves of a glass breaking sound. In addition, the integral H obtained over 30 ms is used to calculate a relative strength of the high frequency components of the detected sound. The value is also used to obtain the continuity of the detected sound (accumulated time ΣTi) for determination of the second waves after detection of the first waves.

FIG. 7E shows the output of the comparator 9, which provides a high level (start signal) only when the amplifier output of the high range smooth output (see FIG. 4) shown in FIG. 7D exceeds the predetermined value. The output from the comparator 9 is used to start the CPU 10 and to calculate an accumulated time ΣTi when the high level is outputted within the second wave detection time period T0 after the first waves have been detected.

FIG. 7F shows the starting of the CPU 10. The CPU 10 is started when the comparator 9 first outputs the high level in response to detection of the first waves. Although not shown, it goes low when the CPU 10 returns to the standby mode in accordance with a result of the determination.

As can be seen in FIGS. 7A–7F, the CPU 10 is started in accordance with the level of the output signal from the microphone 1 to determine occurrence of the first and second waves.

As described above, the peak hold circuit 4 detects a maximum peak value of the detected sound to calculate the relative level occurring a predetermined time later. The outputs from the smoothing circuits 6 and 8 are used to determine a relative strength of the high frequency components included in the detected sound within the predetermined time. These values are used to determine occurrence of the first waves of a glass breaking sound. Thereby, the accuracy in determination of the first waves is improved.

After the first waves of a glass breaking sound are determined, the accumulated time ΣTi in which the output of the smoothing circuit 6 exceeds the predetermined value is measured to examine the continuity of the detected sound. Thus, the accuracy in detection of the second waves of a glass breaking sound can be improved. Since the glass breakage detection signal 7 is outputted when the first and second waves are both detected, the glass breakage detection accuracy is further improved.

The above-described embodiment determines that the detected sound has the attenuation characteristics of the first waves of a glass breaking sound if the ratio of the high range smooth output to the maximum peak value of the detected sound is equal to or less than 0.1. The value 0.1is a value that is suitably set in accordance with the determination time (a time length between the starting of the CPU 10 and the determination, 20 ms according to this embodiment), the sensitivity of the microphone 1, or the characteristics of the smoothing circuit 6. That is, the value varies depending on such conditions.

Although the embodiment determines occurrence of the first waves of a glass breaking sound depending on whether the ratio of the high range smooth output to the maximum peak value occurring 20 ms after the CPU 10 is started reaches the predetermined value, other methods may be used for this determination as long as the determination of the first waves is based on the attenuation characteristics.

For example, occurrence of the first waves of a glass breaking sound may be determined provided that the time needed for the ratio of the high range smooth output to the maximum peak value of the detected acoustic waves to become equal to or less than 0.1 is 20 ms or less. In addition, the first waves may be detected using a system where the time length between the starting of the CPU 10 and the determination of the relative level of the detected sound is set a value different from 20 ms, and the criterion for determining the relative level is set to a value different from that employed in the above embodiment (i.e., 0.1). Furthermore, the first waves may be determined on the basis of the time constant of attenuation of the detected sound. Other methods can also be employed as long as occurrence of the first waves of a glass breaking sound is determined on the basis of the attenuation characteristics of the detected sound.

Although the above embodiment detects the first waves of a glass breaking sound based on the attenuation characteristics of the detected sound and then based on the relative strength of the high frequency components, the determination based on the relative strength of the high frequency components may precede the determination based on the attenuation characteristics. Also, although the embodiment determines the second waves based on the ratio of the accumulated time ΣTi to the second wave detection time T0, other determination methods may also be used.

For example, the second waves may be determined provided that the accumulated time ΣTi reaches a predetermined value within the second wave detection time T0 or provided that the integral of the high range smooth output exceeding a predetermined value reaches a predetermined threshold. In addition, the second waves may also be determined on the basis of the number of incidents where the high range smooth output exceeds a predetermined value or the integral of portions of the high range smooth output exceed a predetermined value. Various methods may be employed as long as the methods use an index that enables discrimination of the extent of the high range smooth output that exceeds a predetermined value.

The above embodiment determines the second waves after determining the first waves and, at the time of determining the second waves, outputs the glass breakage detection signal 7. Since occurrence of the first waves is determined on the basis of the attenuation characteristics of the detected sound and the relative strength of the high frequency components, the determination of occurrence of the first waves indicates a high possibility that the detected sound is a glass breaking sound. Therefore, glass breakage may also be detected on the basis of the relationship between an integral that is weighted with the attenuation characteristics of the detected sound, the relative strength of the high frequency components and the continuity of the high frequency components, and a threshold to the integral.

Although the above embodiment detects the first waves of a glass breaking sound on the basis of both the attenuation characteristics of the detected acoustic waves and the relative strength of the high frequency components, only one of the two factors need be used for determination of occurrence of the first waves.

Although the above embodiment determines occurrence of glass breakage based on the determination of the first waves depending on the attenuation characteristics of the detected sound and the relative strength of the high frequency components and the determination of the second waves depending on the continuity of the detected sound, occurrence of glass breakage may also be determined on the basis of only the determination of the first waves depending on the attenuation characteristics and the relative strength of the high frequency components, without performing determination regarding the second waves.

(Third Embodiment)

Figure 12:
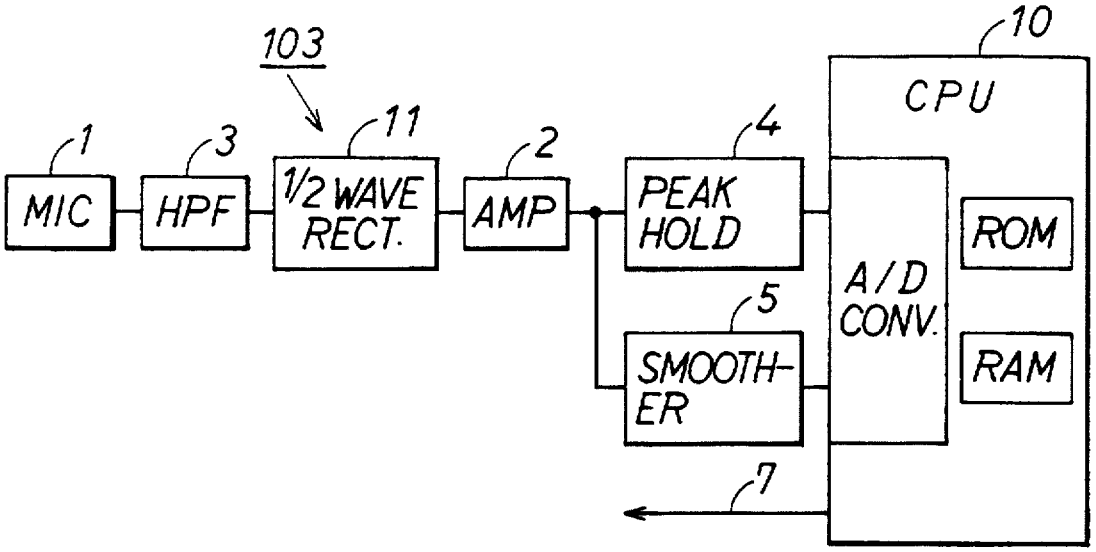
FIG. 12 is a block diagram showing a third preferred embodiment of the present invention.

FIG. 12 is a block diagram of a glass breakage detecting device 103 according to a third embodiment of the present invention. The microphone 1, the high-pass filter 3, the half-wave rectifier circuit 11, the amplifier 2 and the CPU 10 shown in FIG. 12 are substantially the same as those shown in FIG. 1. The amplifier 2 need only have a gain commensurate with the characteristics of the microphone 1, and may be omitted if it is not needed. The high-pass filter 3 corresponds to the first high-pass filter, and the microphone 1 and the high-pass filter 3 correspond to the detecting means.

The amplifier 2 is followed by a smoothing circuit 5 (corresponding to the smoothing means) and a peak hold circuit 4. The smoothing circuit 5 smoothes the output signal from the amplifier 2 and outputs a smoothed value to the CPU 10. The smoothing circuit 5 and the half-wave rectifier circuit 11 correspond to the smoothing means. The peak hold circuit 4 (corresponding to the maximum peak value detecting means) holds a zero-to-peak maximum peak value of the output signal from the amplifier 2 for at least a predetermined time, for example, at least 20 ms, and then provides it to the CPU 10.

The CPU 10 converts the maximum peak value from the peak hold circuit 4 and a first smoothed value from the smoothing circuit 5 into digital values using an A/D converter, stores the digital values in a RAM, and determines occurrence of the first waves and the second waves of a glass breaking sound through software processing (described below) based on a program stored in a ROM. Upon determination of the second waves, the CPU 10 outputs a glass breakage detection signal. The CPU 10 corresponds to the determining means and the first correcting means. The half-wave rectifier circuit 11, the smoothing circuit 5 and the CPU 10 correspond to the calculating means.

The processing flow of the CPU 10 of the glass breakage detecting device 103 constructed as described above will be described with reference to FIGS. 14–16.

The CPU 10 first reads the first smoothed value from the smoothing circuit 5 (Step 500), and determines whether the first smoothed value is greater than a predetermined criterion (Step 502). If the first smoothed value is less than the criterion, it is considered that there is no acoustic wave that needs determination. Then the CPU 10 inputs the background noise (Step 510), and returns to Step 500. If Step 502 determines that the first smoothed value is greater than the criterion, it is determined that the first waves of a glass breaking sound have risen, and the CPU 10 goes on to attenuation determination.

The background noise corresponds to an electrical signal outputted from the detecting unit during periods when neither the determination by the first wave determining unit nor the calculation by the calculating unit is being performed. The criterion used in Step 502 is set with reference to the level of the background noise thus inputted.

If Step 502 determines that the first smoothed value is greater than the criterion, the CPU 10 waits for only 10 ms (Step 503) and proceeds to Step 504. After Step 504 reads the maximum peak value occurring in 10 ms, the CPU 10 waits for another 10 ms (Step 505), and reads the first smoothed value that occurs at least 20 ms after the first smoothed value has exceeded the criterion (Step 506). Then the CPU 10 determines whether the ratio of the first smoothed value to the maximum peak value is equal to or less than 0.1, that is, whether the first smoothed value is equal to or less than 1/10 of the maximum peak value (Step 508). If this condition is met, it is then determined that the detected acoustic waves exhibit the attenuation characteristics of the first waves, and the CPU 10 waits for 200 ms (Step 512). The processing up to the affirmative determination in Step 508 corresponds to the first wave determining means.

When the condition in Step 508 is not met, it is determined that the detected acoustic waves are not the first waves of a glass breaking sound, and the operation returns to Step 500. The waiting time of 200 ms in Step 512 is a time necessary for the first waves to sufficiently attenuate.

The After waiting for 200 ms in Step 512, the CPU 10 determines whether the time (2000 ms) necessary for the second waves to sufficiently attenuate has elapsed (Step 514). If that time has not elapsed yet, the operation proceeds to Step 516 shown in FIG. 15, which reads the first smoothed value. If Step 514 determines that 2000 ms has elapsed, it is determined that the second waves have attenuated, and the operation returns to Step 500.

The time from 200 ms to 2000 ms corresponds to the predetermined time period. This predetermined time period is set to any value after determination of the first waves. Then the CPU 10 determines whether the first smoothed value is equal to or greater than a value obtained by multiplying the background noise by a constant (corresponding to the predetermined level) (Step 518). The constant used in Step 518 is set to 1.1 according to this embodiment.

If the condition is in Step 518 is met, it is determined that there are acoustic waves that need determination, and a detection flag is set (Step 520). During the detection of acoustic waves, the CPU 10 determines whether there is an attenuating sound substantially equivalent to the first waves, to avoid determining an impact sound caused by, for example, mischievous intention, as a glass breakage.

More specifically, after the detection flag is set up, the CPU 10 reads the first smoothed value (Step 524), and determines whether the first smoothed value is greater than a predetermined criterion (Step 526). If the condition in Step 526 is not met, it is determined that there is no acoustic wave that needs determination, and the operation proceeds to Step 534. If Step 526 determines that the first smoothed value is greater than the criterion, it is determined that there are acoustic waves that need determination.

Then, the CPU 10 detects a maximum peak value occurring during 10 ms following the setting up of the detection flag (Step 528), and reads the first smoothed value occurring at least 20 ms after the setting of the detection flag (Step 530). Then the CPU 10 determines whether the ratio of the first smoothed value to the maximum peak value is equal to or less than 0.1 (Step 532).

If Step 532 determines that the ratio of the first smoothed value to the maximum peak value is greater than 0.1, it is determined that there is no attenuating sound occurring after detection of the first waves. It is determined that there is no influence of an impact sound caused by mischievous intention or the like, and the operation proceeds to Step 534. If Step 532 determines that the ratio of the first smoothed value to the maximum peak value is equal to or less than 0.1, it is determined that there is an attenuating sound occurring, and the CPU 10 subtracts 20 (corresponding to the predetermined value of the subtraction correction) from the counter value (Step 533). The processing in Step 533 corresponds to the first correcting means.

Figure 16:
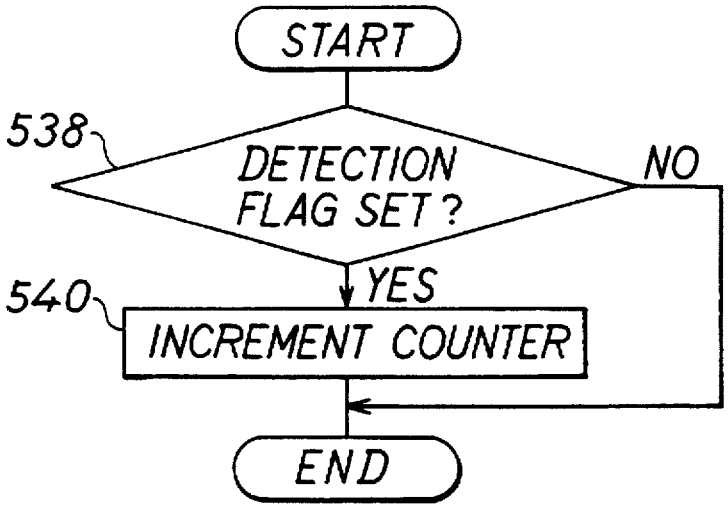

The counter value is a value counted by a 1-ms interrupt processing routine shown in FIG. 16. That is, it is first determined whether the detection flag is set (Step 538). If the detection flag is set, the counter value is incremented for counting (Step 540). Thus the counter value indicates the accumulation of time when the detection signal reaches the value (background noise×constant). The processing illustrated in FIG. 16 corresponds to the calculating means.

After Step 533 subtracts 20 from the counter value, the CPU 10 determines whether the counter value has reached 30 (corresponding to the predetermined value) (Step 534). If the counter value has not reached 30 yet, the operation returns to Step 514 in FIG.14. If Step 534 determines that the counter value has reached 30, it is determined that the detected acoustic waves exhibit the slow-speed attenuation characteristics of the second waves gradually attenuating, and the CPU 10 outputs a glass breakage signal (Step 536). The processing in Steps 534 and 536 corresponds to the determining means.

Through the above-described processing, the CPU 10 determines occurrence of the first waves based on the attenuating characteristics and occurrence of the second waves based on the slow-speed attenuation characteristics and thereby detects glass breakage with high accuracy, distinguished from a conventional system which detects acoustic waves, converts them into electrical signals, and detects glass breakage depending on whether the signal level of a particular frequency component reaches a threshold.

Figure 17:
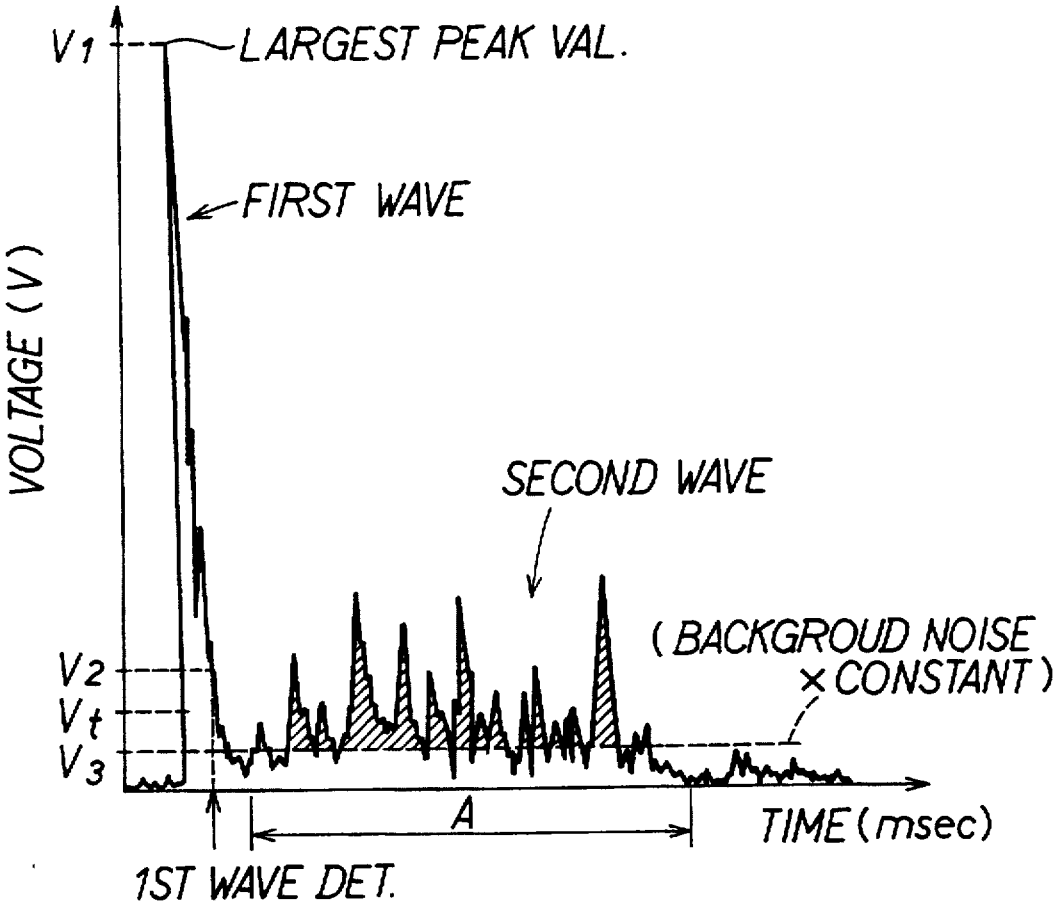
FIG. 17 shows the method of detecting the first waves and the second waves according to the third embodiment.

FIG. 17 shows the waveform of the first waves and the second waves over time. When the first smoothed value reaches the criterion value Vt, the maximum peak value V1 is detected by the peak hold circuit 4. Then a first smoothed value V2 outputted from the smoothing circuit 5 20 ms after is inputted, and it is determined whether the first smoothed value V2 is equal to or less than 1/10 of the maximum peak value V1. In this way, the attenuation rate of the first smoothed value V2 over 20 ms relative to the maximum peak value V1 can be found so that the first waves can be detected with a high accuracy regardless of the magnitude of the signal level.

The second waves can be detected with high accuracy on the basis of an accumulated time during which the first smoothed value is greater than the predetermined value V3 (background noise×constant) within the predetermined time period A after detection of the first waves. The second waves provide several peak values of relatively large magnitudes and include a waveform where rapid attenuation occurs after a peak value and a waveform where gradual attenuation occurs after a peak value. Since the waveform having gradual attenuation lasts longer, the second waves can be detected with high accuracy by omitting the rapidly attenuating waveform from the factors for determination and using the gradually attenuating waveform as a factor for determination of the second waves.

As shown in FIG. 17, although the rapidly attenuating waveform of the second waves goes below the predetermined value V3, the portions exceeding the predetermined value V3 last for long periods of time. Therefore, the second waves can be detected with high accuracy by using the portions exceeding the predetermined values as a factor for determination, that is, using the accumulated time of those portions. The result of detection of the second waves by this method in an example is shown in FIG. 24, where detection times of 30 ms or longer were obtained for 58 sample sounds.

Although this embodiment determines occurrence of the second wave based on the accumulated time during which the first smoothed value is greater than the predetermined value V3, occurrence of the second waves may be determined based on the number of incidents where the predetermined value V3 is exceeded, or the integral of portions where the predetermined value V3 is exceeded (indicated by a shadowed area in FIG. 17). Thus, various types of indices may be employed as long as they enable discrimination of the degree of excess over the predetermined value V3.

Figure 18:
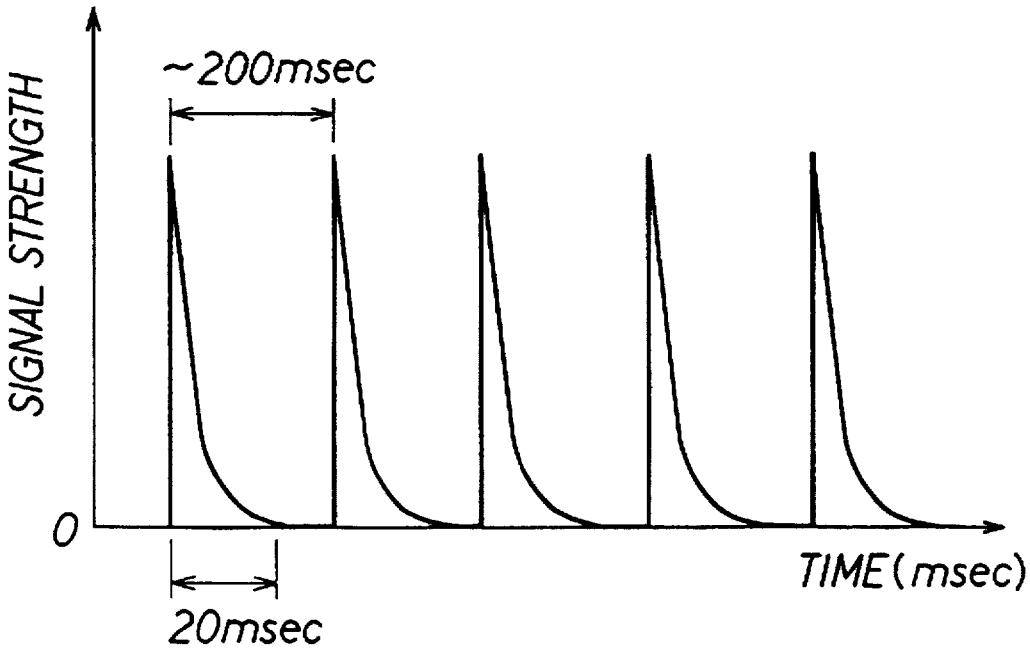
FIG. 18 shows a schematic waveform over time formed by continual impacts made by mischievous intention of the like, and FIG. 19 shows such a waveform where the impacts are followed by a glass breaking sound.

It is possible to avoid determining an impact sound caused by, for example, mischievous intention, as a glass breakage. FIG. 18 shows a schematic waveform over time that occurs when glass is continually struck by, for example, mischievous intention. Impact sounds reaching the threshold for detection of the second waves occur at intervals of about 200 ms, and each impact sound attenuates in 20 ms. If the first impact sound in this series is determined as the first waves, the counting of an accumulated time is started when the second impact sound reaches the value (background noise× constant). In this case, since occurrence of the second waves will be determined when the accumulated time reaches 30 ms as a predetermined time, there is a possibility that impact sounds produced by mischievous intention will be determined as a glass breakage.

However, if this embodiment detects attenuation characteristics in the second waves similar to those of the first waves after determining a first impact sound as the first waves, the embodiment subtracts 20 ms, the time used for detection of the attenuation characteristics, from the counter value. Thus, the embodiment avoids counting accumulated time in an event of continual striking performed by mischievous intention or the like. Since the counter value does not reach the value (30 according to this embodiment) for determination of a glass breakage in such a case, the embodiment avoids determining an impact sound produced by, for example, mischievous intention, as a glass breakage.

In addition to avoiding determining continual impact sounds as a glass breakage, this construction will detect a glass breakage without failure if a glass breakage actually occurs, for example, after continual impact sounds.

Figure 19:
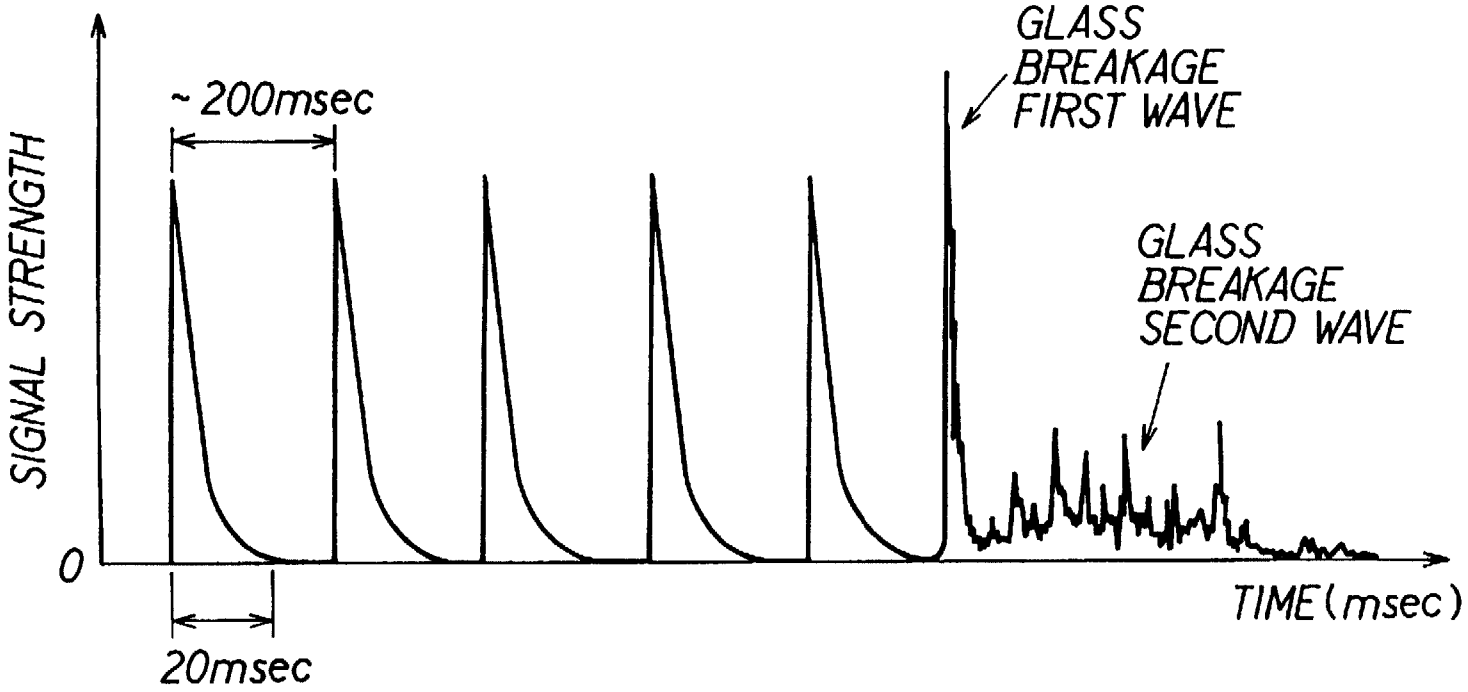

FIG. 19 shows a schematic waveform over time that occurs when glass breakage occurs after continual striking. Even if the first impact sound is determined as the first waves, the time from the second impact sound up to the first waves of the actual glass breaking sound is not counted as an accumulated time, since the waves occurring during that time are considered to have attenuation characteristics similar to those of the first impact sound. However, since the second waves of the glass breaking sound have gradually attenuating characteristics different from those of the first waves that rapidly attenuate, the accumulated time during which the level of second waves is greater than the value (background noise×constant) is counted. When the accumulated time reaches 30 ms as a predetermined time, occurrence of the second waves is determined.

Since this embodiment avoids determining occurrence of glass breakage in the case of only continual impact sounds but determines occurrence of a glass breakage if a glass breakage occurs after continual striking, the embodiment improves accuracy in detection of glass breakage.

Figure 14:
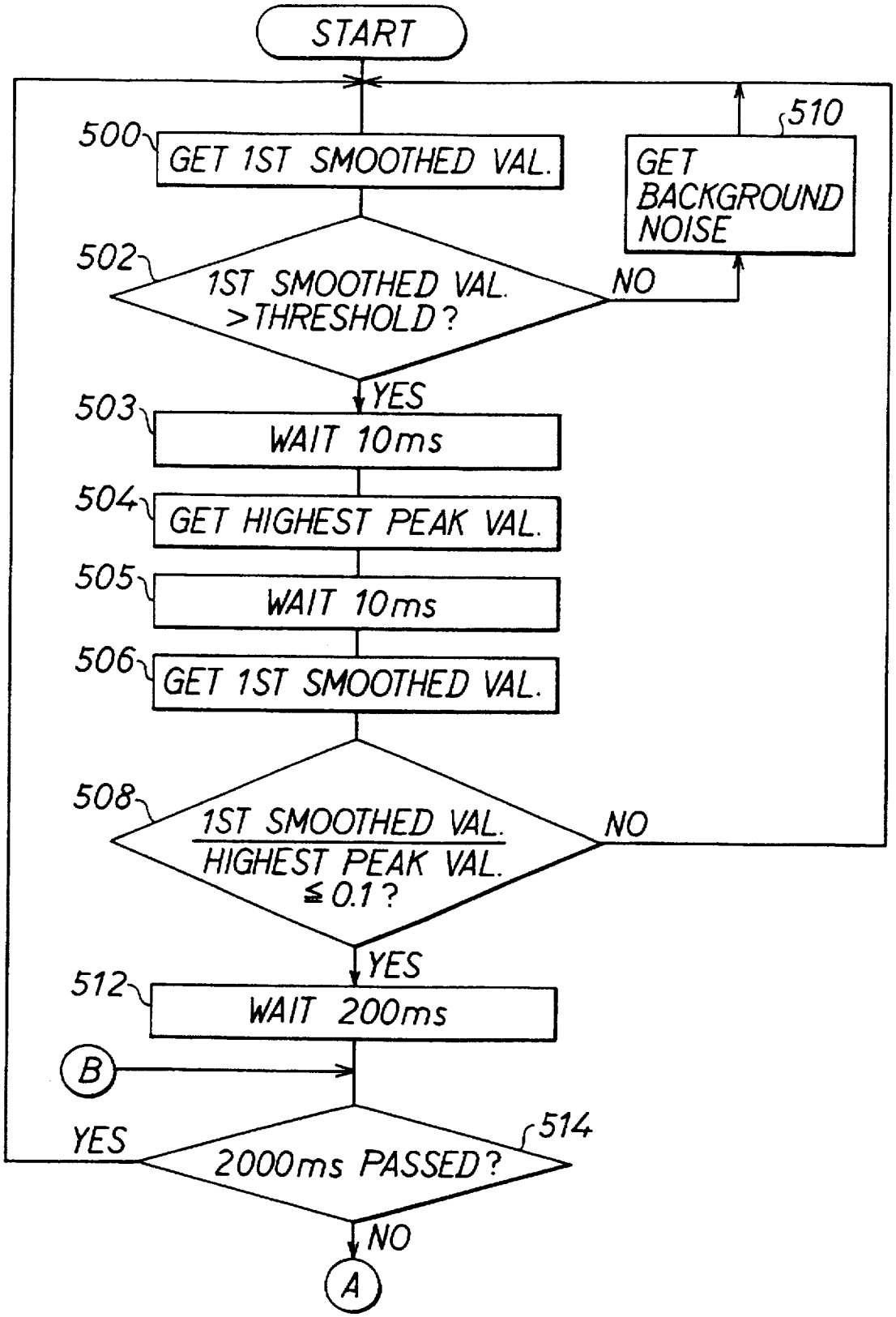
FIG. 14–16 are flowcharts showing the processing flow of the CPU in the third embodiment.
Figure 15:
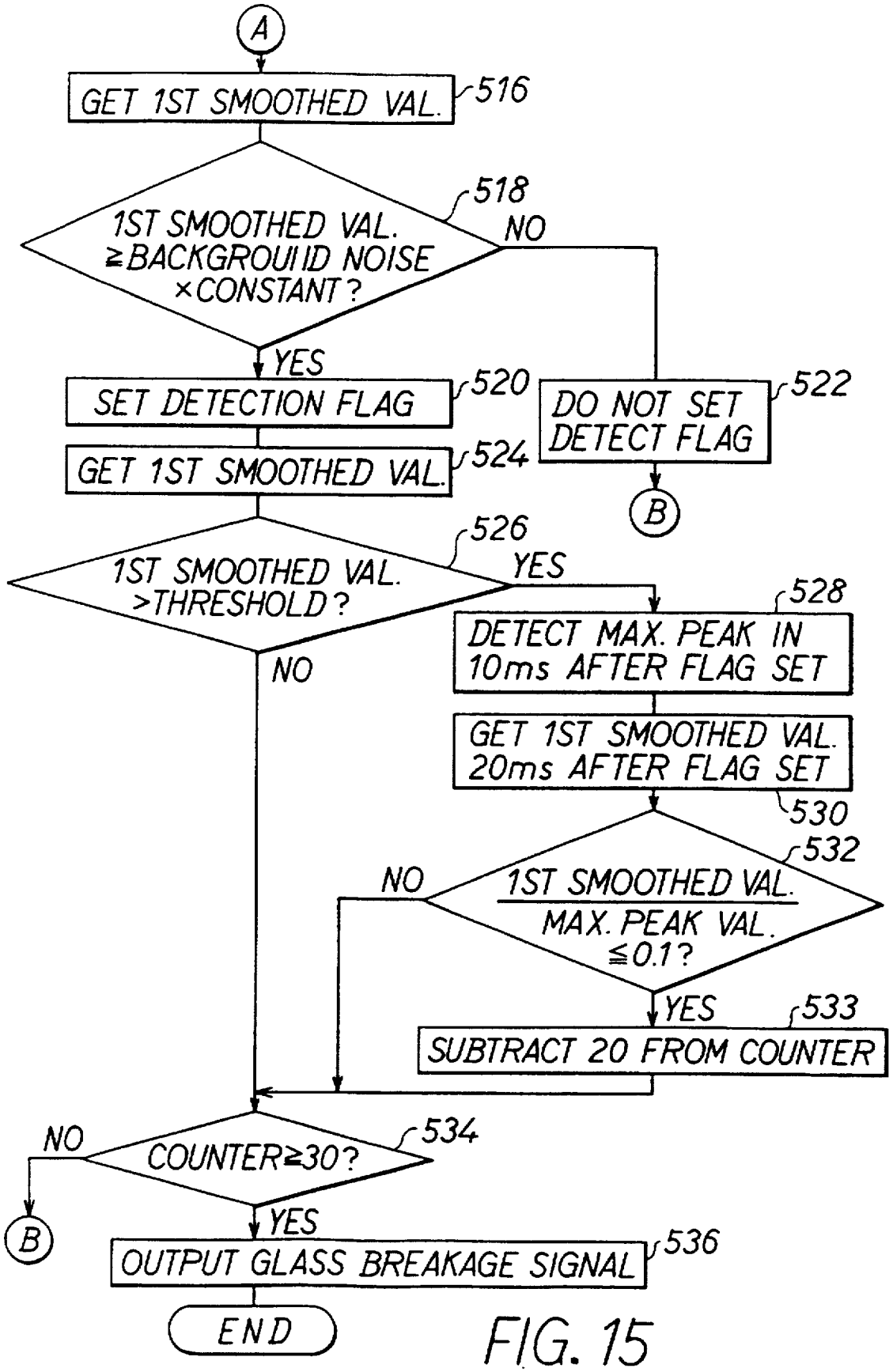

According to the flowchart shown in FIG. 14, the output signal of the microphone 1 s constantly monitored, and the level of the output signal of the microphone 1 is stored as a background noise every time the first smoothed value fails to reach the predetermined criterion. However, it is possible to store background noise only when necessary.

For example, in an optional construction, a circuit for outputting a rectangular waveform signal at a fixed interval is provided to periodically start the CPU 10, and a circuit for generating a trigger signal when the output signal of the microphone 1 exceeds a predetermined criterion is provided. The presence of output signal of the microphone 1 may be checked every time the rectangular waveform signal is outputted. If the output signal of the microphone 1 does not reach the predetermined criterion, the output signal of the microphone 1 may be stored as background noise. When a trigger signal occurs, the CPU 10 may be operated continuously. In this way, it becomes unnecessary to constantly operate the CPU 10, thereby reducing power consumption of the glass breakage detecting device 103.

The background noise may be inputted by sampling many data (for example, eight data points) at short intervals (for example, 0.1 ms) and storing the mean of these data as a background noise, or by calculating a moving average of the currently detected background noise and the previously stored background noise and storing the average as a background noise. Using such background noise averaging processes, the embodiment can exclude isolated noise and, therefore, stably perform detection of a glass breaking sound.

Although the presence of the input signal at the microphone 1 is determined if the first smoothed value is greater than 5 mV, the criterion determined according to this embodiment, and denied if the first smoothed value is equal to or less than 5 mV, the criterion needs to be determined in accordance with the gain of the amplifier 2, the sensitivity of the microphone 1 and the like.

Although the embodiment has the threshold for detection of the second waves set to a result of multiplication of the background by a constant which is set to be 1.1, it is possible to easily set this constant to any value suitable to the operating environment using the CPU 10 for more accurate detection of a glass breakage.

Figure 20:
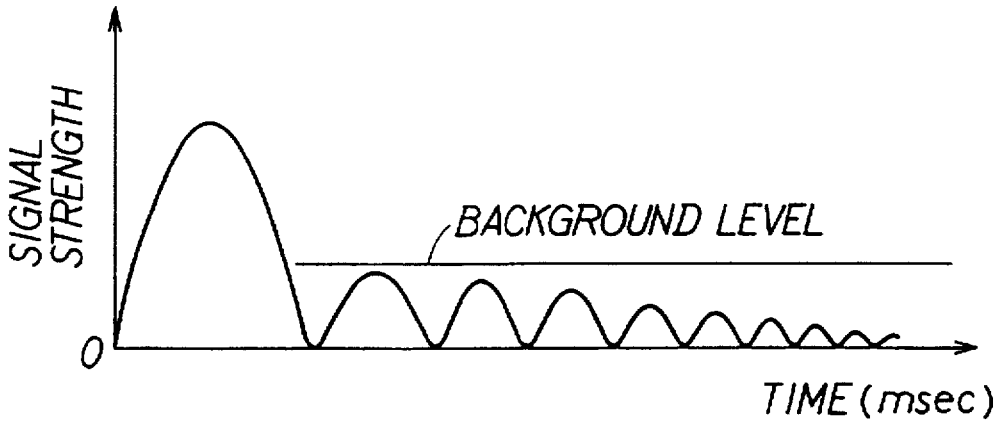
FIG. 20 shows a schematic waveform over time caused by a soft body impact.

In addition, it is possible to avoid determining an impact sound that slowly attenuates as the second waves by setting a predetermined threshold for the background noise in determination of the threshold for detection of the second waves and, if the background noise is equal to or less than the threshold, setting the threshold as a background noise. FIG. 20 shows an attenuating waveform that occurs when a soft body impacts a large size pane as an example of slow attenuation. Since the attenuating waveform gradually attenuates as shown in FIG. 20, such an impact sound may possibly be detected as the second waves if the value of background noise is small. This possibility of detecting the impact sound as the second waves can be eliminated by setting the value of background noise to a threshold if the background noise is actually equal to or less than the threshold to increase the threshold for detection of the second waves, that is, the value (background noise× constant). The threshold for the background noise should be determined in accordance with the circuit gain, the microphone sensitivity or the like.

Although the above-described embodiment determines occurrence of the first waves if the ratio of the first smoothed value occurring 20 ms after the time point of the first smoothed value reaching the criterion to the maximum peak value occurring during 10 ms after the same time point is equal to or less than 0.1, occurrence of the first waves may be determined if the time starting when the first smoothed value reaches the criterion and ending when the ratio of the first peak value to the maximum peak value becomes equal to or less than 0.1 is shorter than 20 ms. The value 0.1 is a value that is suitably set in accordance with the determination time (time after the first smoothed value reaches the criterion, 20 ms according to this embodiment), or the characteristics of the smoothing circuit 5. That is, the value varies depending on such conditions.

Although the embodiment uses the smoothing circuit 5 to detect the first smoothed value, it is also possible to use as a substitute for the first smoothed value the mean of the peak values sampled from peak values that have been stored while the holding time of the peak hold circuit 4 is set to a short time. This optional construction allows the smoothing circuit 5 to be omitted from the glass breakage detecting device 103. It is also possible to reduce the time constant of the smoothing circuit 5 and read the peak value from this circuit, so that the peak hold circuit 4 may be omitted.

Although this embodiment determines occurrence of the first waves by comparing the maximum peak value outputted from the peak hold circuit 4 with the first smoothed value outputted from the smoothing circuit 5, it is also possible to use, instead of the smoothing circuit 5, a second peak hold circuit whose holding time is set to a considerably shorter time than the holding time of the peak hold circuit 4 to detect the latest peak value so that occurrence of the first waves may be determined by comparing the latest peak value and the maximum peak value.

Although the embodiment detects the first waves based on the attenuating characteristics of the detected sound, it is also possible to detect the first waves based on the frequency characteristics of the detected sound. It is also possible to use both the frequency characteristics and the attenuating characteristics to detect the first waves. Further, it is possible to construct the peak hold circuit 4 and the smoothing circuit 5 of the glass breakage detecting device 103 from a digital circuit or a digital circuit comprising a CPU.

Although the embodiment employs the high-pass filter 3 as a filter, it is also possible to provide a low-pass filter that suppresses a particular frequency and high frequencies or a band-pass filter that transmits only the frequencies within a particular frequency band, as long as the attenuating characteristics of detected sounds can be measured.

Although the high-pass filter 3 is followed by the half-wave rectifier circuit 11 for converting the electrical signals to absolute values, it is also possible to provide a full-wave rectifier circuit instead of the half-wave rectifier circuit 11 for an improvement of detection precision.

The rectifier circuit following the high-pass filter 3 may be omitted for detection of peak-to-peak value in an alternating waveform.

The smoothing circuit 5 may be a smoothing filter employing a passive element. The smoothing circuit 5 may also be combined with the half-wave rectifier circuits 11 and the amplifier 2 into a unit by using an envelope detector circuit or the like.

(Fourth Embodiment)

Figure 21:
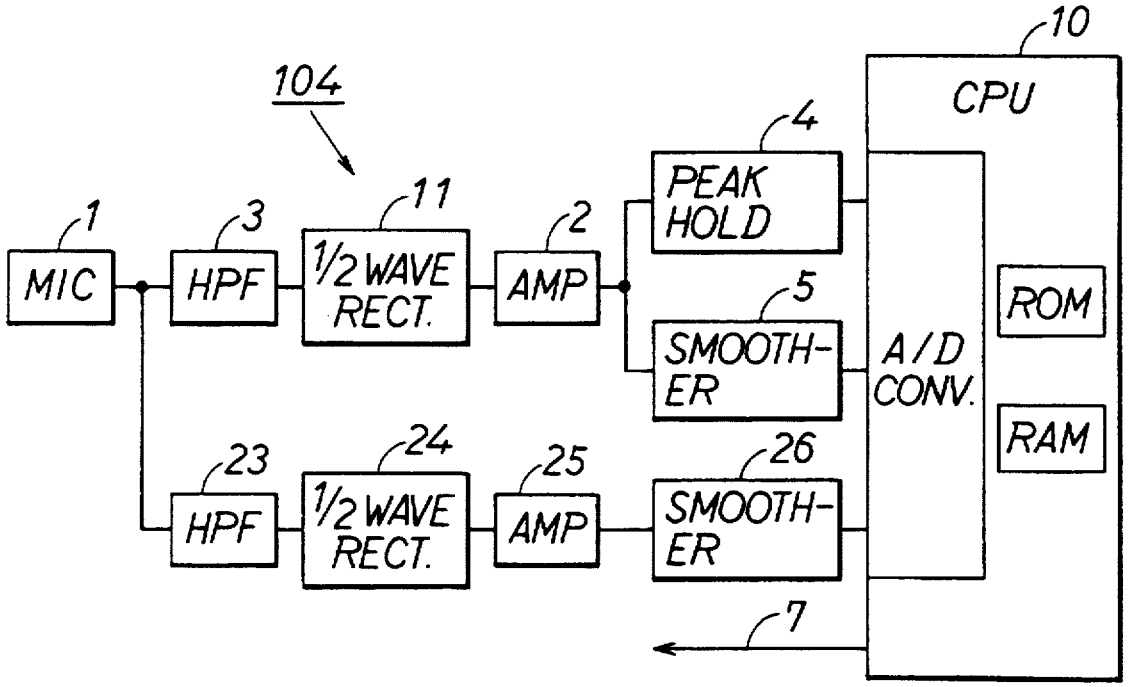
FIG. 21 is a block diagram showing a fourth embodiment of the present invention.

FIG. 21 is a block diagram showing the construction of a glass breakage detecting device 104 according to a fourth preferred embodiment of the present invention. The glass breakage detecting device 104 is constructed by adding a high-pass filter 23, a half-wave rectifier circuit 24, an amplifier 25 and a smoothing circuit 26 to the system of the third embodiment. The microphone 1, the high-pass filter 3, the half-wave rectifier circuit 11, the amplifier 2, the peak hold circuit 4 and the smoothing circuit 5 of the glass breakage detecting device 104 operate as described above.

The cut-off frequency of the high-pass filter 23 (corresponding to the second high-pass filter) is set to as low as 50 Hz (corresponding to the second frequency), compared with the cut-off frequency (2 kHz) of the high-pass filter 3. The high-pass filter 23 removes low frequency components of 50 Hz or lower from the output signals of the microphone 1, and extracts only frequency components of 50 Hz or higher.

The half-wave rectifier circuit 24 half-wave rectifies the output signal of the high-pass filter 23. The amplifier 25 amplifies the output signal of the half-wave rectifier circuit 24. The smoothing circuit 26 smoothes the output signal from the amplifier 25 and outputs a second smoothed value to the CPU 10. The first and second smoothed values mean the integrals of the signals transmitted through the high-pass filters 3 and 12, respectively, that is, the extents of the magnitude of the sound.

Figure 23:
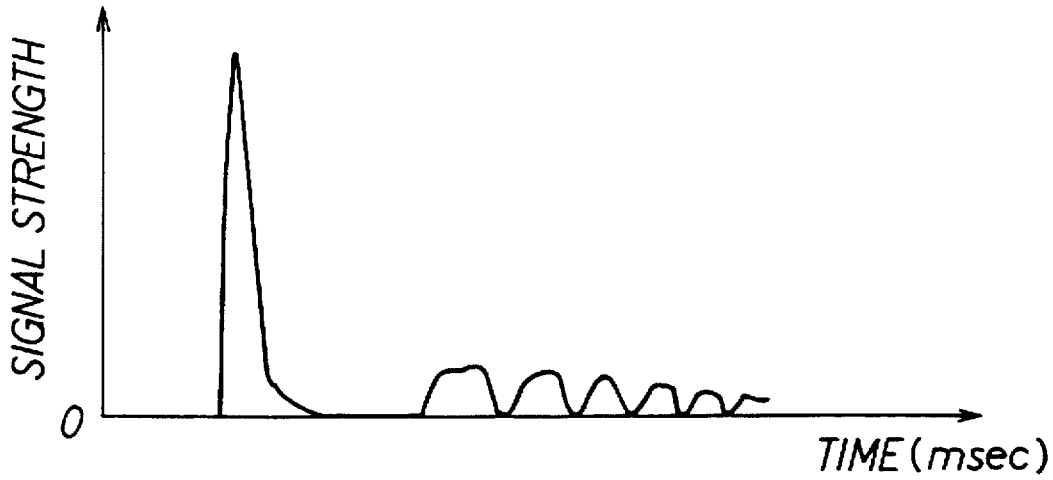
FIG. 23 shows a schematic waveform over time caused by complex impacts made by a hard body and a soft body.

In the glass breakage detecting device 104 thus described, the first and second smoothed values having different frequency components are inputted to the CPU 10 so that the CPU 10 can detect the second waves with higher accuracy by using the ratio of the first smoothed value to the second smoothed value, that is, the high frequency component ratio. FIG. 23 shows a schematic waveform over time (absolute value processing) resulting from complex impacts where a hard body and a soft body impact glass. As shown, the impact by a hard body produces a waveform having large amplitudes and attenuating rapidly, resembling the waveform of the first waves. On the other hand, the impact by a soft body produces a waveform having small amplitudes and attenuating gradually, resembling the waveform of the second waves.

Therefore, there is a possibility that the glass breakage detecting device 104 will detect the second waves when a soft body impacts glass 200 ms after detecting an impact by a hard body as the first wave. However, the second waves of a glass breaking sound and waves caused by the complex impacts by a hard body and a soft body can be discriminated by using the frequency component ratio.

The processing flow of the glass breakage detecting device 104 constructed as described above will be described with reference to FIG. 22.

The processing of detecting the first waves based on the first smoothed value, waiting for 200 ms, and determining whether 2000 ms has elapsed, is the same as shown in the flowchart of FIG. 14. The interrupt for adding a counter value is the same as shown in FIG. 16.

Figure 22:
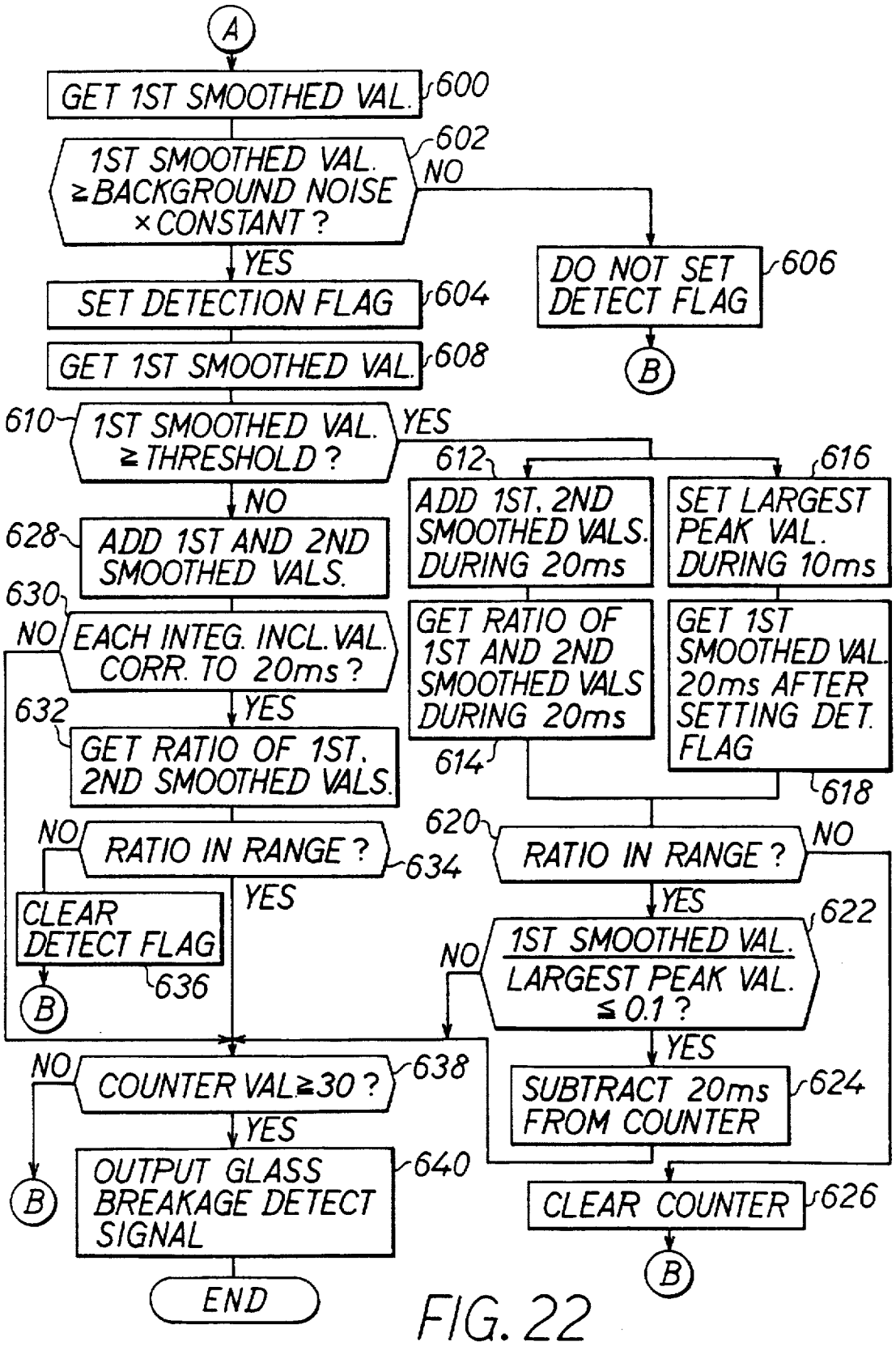
FIG. 22 is a flowchart showing the processing flow of the CPU according to a fourth embodiment of the present invention.

If Step 514 in FIG. 14 determines that 200 ms has not elapsed, the operation proceeds to Step 600 in FIG. 22. The CPU 10 reads the first smoothed value (Step 600) and determines whether the first smoothed value is equal to or greater than a value (background noise×constant) (Step 602). The constant used in Step 602 is set to 1.1 as in the first embodiment. If Step 602 determines that the first smoothed value is less than the value (background noise×constant), it is determined that there is no acoustic wave that needs determination, and the operation returns to Step 514 in FIG. 14 without setting up the detection flag (Step 606). If Step 602 determines that the first smoothed value is equal to or greater than the value (background noise×constant), it is considered that there are acoustic waves that need determination, the CPU 10 sets up the detection flag (Step 604) and reads the first smoothed value (Step 608).

Then, the CPU 10 determines whether the first smoothed value read in Step 608 is equal to or greater than a predetermined criterion (Step 610). If the first smoothed value is equal to or greater than the criterion, the CPU 10 samples and adds the first and second smoothed values having different frequencies that occur during 20 sec following the setting of the detection flag (Step 612), and calculates a ratio of the integral of the first smoothed value to the integral of the second smoothed value (Step 614). The sampling interval needs to be set to a time sufficiently shorter than the detection time. According to this embodiment, the sampling is done at an interval of 1 ms, and the integrals of the first and second smoothed values are calculated by moving integral processing. The processing in Step 614 corresponds to the component ratio calculating means.

In parallel with the processing in Steps 612 and 614, the CPU 10 holds a maximum peak value occurring during 10 ms following the setting up of the detection flag (Step 616), and reads the first smoothed value occurring 20 ms following the setting up of the detection flag (Step 618), and proceeds to Step 620.

Step 620 determines whether the ratio of the integral of the first smoothed values to the integral of the second smoothed values calculated in Step 614 is within a predetermined range. Since the second waves normally include high frequency components to some extent, this embodiment sets the predetermined range in Step 620 to, for example, 20–80%. If the ratio of the integral of the first smoothed values to the integral of the second smoothed values is 20–80%, it is determined that the detected acoustic waves may possibly be the second waves of a glass breaking sound, and the operation proceeds to Step 622. If the ratio of the integral of the first smoothed values to the integral of the second smoothed values is 0–20% or 80–100%, it is determined that the detected acoustic waves do not result from a glass breaking sound but resulting from an impact, the counter value is cleared (Step 626) and the operation returns to Step 514 in FIG. 14. The processing from Step 620 to Step 626 corresponds to the second correcting means. The predetermined range in Step 620 needs to be set for each circuit used, since the range varies depending on the amplifier gain.

The processing following Step 622 is the same as in the first embodiment. That is, the CPU 10 determines whether the ratio of the first smoothed value to the maximum peak value is equal to or less than 0.1 (Step 622). If the ratio is greater than 0.1, the operation proceeds to Step 638. If Step 622 determines that the ratio of the first smoothed value to the maximum peak value is equal to or less than 0.1, it is determined that the acoustic waves detected after the first waves are an impact sound produced by a hard body or the like, the CPU 10 subtracts 20 from the counter value (Step 624) and proceeds to Step 638.

Step 638 determines whether the counter value has reached 30. If the counter value has not reached 30, it is determined that the detected acoustic waves do not exhibit the slow attenuating characteristics of the second waves, and the operation returns to Step 514 in FIG. 14. If Step 638 determines that the counter value has reached 30, it is determined that the detected acoustic waves exhibit the slow attenuating characteristics of the second waves, and the CPU 10 outputs the glass breakage detection signal (Step 640).

If Step 610 determines that the first smoothed value does not reached the criterion, the first and second smoothed values are provided with integral of amounts corresponding to 20 ms at each calculating timing (Step 628) after the second wave detecting routine has been started (Step 600 or later steps). The CPU 10 then determines whether each of the two integrals is a value including an amount corresponding to 20 ms (Step 630). If either of the integrals is not a value including an amount corresponding to 20 ms, which means the component ratio is not accurate, then the operation proceeds to Step 638. If each integral is a value including an amount corresponding to 20 ms, the CPU 10 calculates a ratio of the integral of the first smoothed value to the integral of the second smoothed value (Step 632).

Then, the CPU 10 determines whether the value of the ratio calculated in Step 632 is within the predetermined range of 15–80% (Step 634). If the ratio is within the predetermined range, it is determined that the detected acoustic waves are the second waves of a glass breaking sound, and the operation proceeds to Step 638. If Step 634 determines that the ratio of the integral of the first smoothed value to the integral of the second smoothed value is not within the predetermined range, it is determined that the detected acoustic waves are not the second waves of a glass breaking sound but an impact sound, the detection flag is cleared (Step 636) and the operation returns to Step 514 in FIG. 14.

Although this embodiment uses the integral occurring during 20 ms, it is desirable that the integral be performed for as long a period as possible provided that the integral period does not affect the detection of the attenuating sound included in the second waves, since the calculation of the high frequency components will become more accurate as the integral time is longer.

With the CPU 10 performing this operation and using the ratio between the integrals of the first and second smoothed values having different frequencies, this embodiment avoids determining complex impacts caused by a hard body and a soft body as glass breakage, besides achieving the advantages as in by the first embodiment.

This embodiment, after detecting the first waves, measures a time length during which the detected acoustic waves exceed the criterion level (background noise×constant) and the high frequency component ratio is within the predetermined range. However, since the possibility of the detected waves being the second waves is higher as the value of the accumulated time during which the high frequency component ratio is within the predetermined range is greater, it is also possible to determine occurrence of the second waves by considering both the accumulated time value and the counter value in combination.

Although the embodiment employs the two high-pass filters having cut-off frequencies of 2 kHz and 50 Hz, it is also possible to employ a plurality of band-pass filters having different pass bands as in the first embodiments in order to determine the frequency component ratio, or to employ a plurality of band-pass filters whose pass bands overlap one another in order to determine the frequency component ratio. If many filters are to be employed in this manner, it is necessary to measure actual glass breaking sounds and determine thresholds in accordance with the frequency bands to be used.

(Fifth Embodiment)

Figure 26:
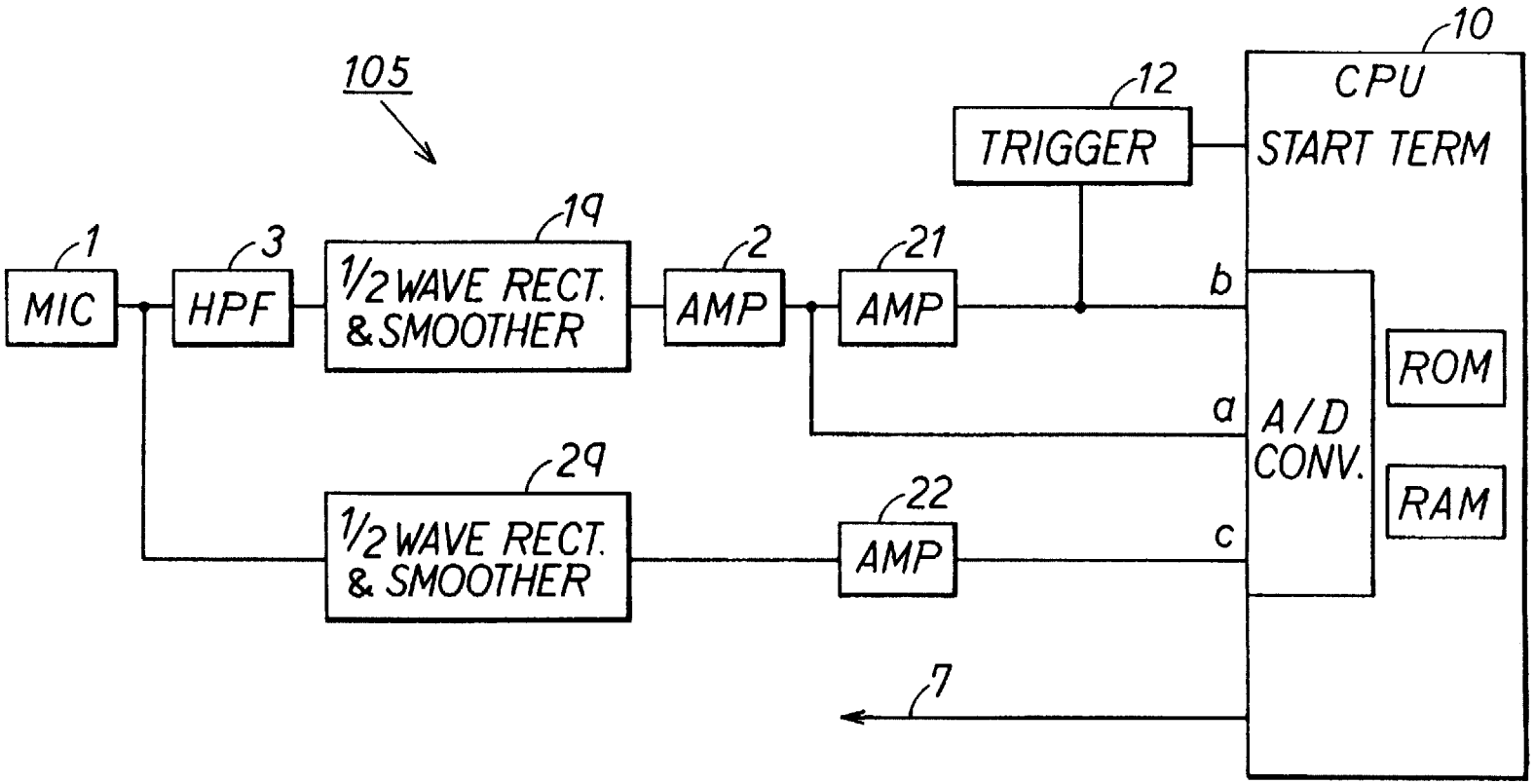
FIG. 26 is a block diagram showing a fifth embodiment of the present invention.

FIG. 26 is a block diagram of a glass breakage detecting device 105 according to a fifth preferred embodiment of the present invention. In FIG. 26, the microphone 1, the high-pass filter 3, the amplifier 2, the trigger circuit 12, and the CPU 10 are constructed the same as those in FIG. 1, and operate in the same manner as described above.

A half-wave rectifying and smoothing circuit 19 (corresponding to the smoothing means) is provided between the high-pass filter 3 and the amplifier 2. The signal from which frequency components of 2 kHz or lower have been removed by the high-pass filter 3 is converted into absolute values through half-wave rectification and smoothed and outputted to the amplifier 2 by the circuit 19. The signal amplified by the amplifier 2 is outputted as a high range smoothed output a to the CPU 10. The output signal of the amplifier 2 is also outputted to an amplifier 21 that follows the amplifier 2. The amplifier 2 need only have a gain commensurate with the characteristics of the microphone 1, and may be omitted if it is not needed.

The amplifier 21 is provided for further amplifying the amplified output signal (sound pressure or voltage) of the amplifier 2 if the signal is small. The signal amplified by the amplifier 21 is outputted as a high range amplifier smoothed output b to the CPU 10 and also to the trigger circuit 12. The trigger circuit 12 outputs a start pulse to a start terminal of the CPU 10 to start the CPU 10 only when the output from the amplifier 21 reaches a predetermined value.

The signal detected by the microphone 1 is outputted to a half-wave rectifying and smoothing circuit 29 (corresponding to the smoothing means), as well as to the high-pass filter 3. The circuit 29 half-wave rectifies the signal to convert it to an absolute value and also smoothes the signal. Then the signal is amplified by an amplifier 22 that follows the half-wave rectifying and smoothing circuit 29. The signal is then outputted as a full range smoothed output c to the CPU 10.

The CPU 10 is started by the start pulse from the trigger circuit 12. The CPU 10 converts the smoothed outputs a, b and c into digital signals using an A/D converter, calculates an integral and a maximum peak value occurring in a predetermined period, stores these values into a RAM, determines occurrence of a glass breakage through processing (described below) based on a program stored in a ROM and outputs a glass breakage detection signal 7. In this manner, this embodiment determines a peak hold value through internal operation of the CPU 10 without employing a peak hold circuit.

The processing flow of the CPU 10 of the glass breakage detecting device 105 will be described with reference to FIGS. 27–29.

Figure 27:
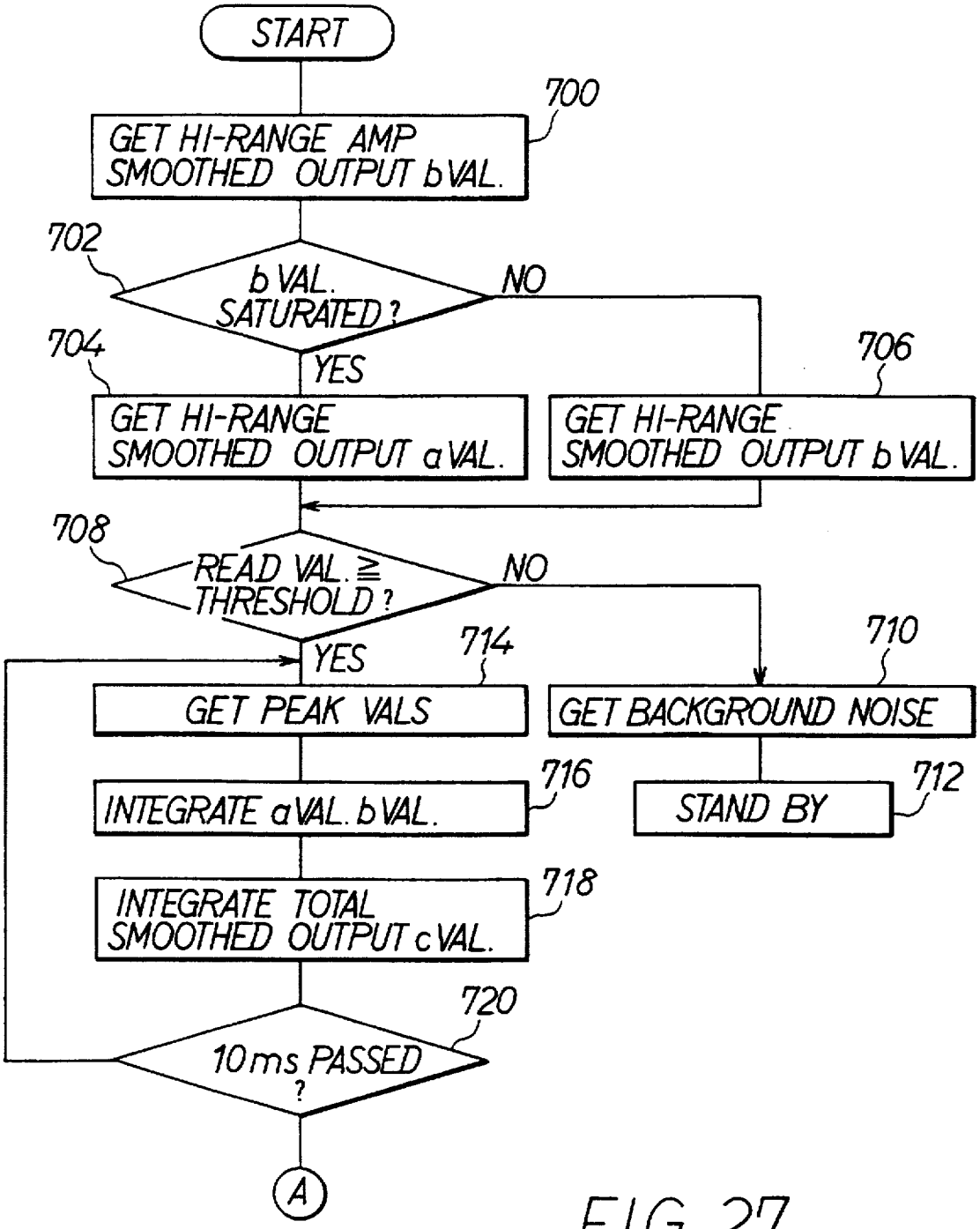
FIGS. 27–29 are flowcharts showing the processing flow of the CPU according to the fifth embodiment.

First, referring to FIG. 27, when the output signal of the amplifier 21 reaches a predetermined value, the trigger circuit 12 is started and outputs a start pulse to the start terminal of the CPU 10, thus starting the CPU 10. Then the CPU 10 inputs the high range amplifier smoothed output b (Step 700), and determines whether the value b is saturated (Step 702). If the value b is saturated, the CPU inputs the high range smoothed output a (Step 704). If the value b is not saturated, the CPU inputs the high range amplifier smoothed output b (Step 706). The processing in Steps 702–706 uses the high range amplifier smoothed output b if the value b is not saturated. If the value b is saturated, the processing uses the value a, which is not saturated, to avoid a decrease in detection precision due to signal saturation. Although, according to this embodiment, this processing is executed only when the CPU 10 is just started, processing precision can be improved if this processing is executed every time such a value is inputted.

The CPU 10 determines whether the value inputted in Step 704 or 706 is equal to or greater than a predetermined criterion (Step 708). If it is less than the criterion, it is determined that there is no acoustic wave that needs determination, and the CPU 10 inputs background noise (Step 710) and enters the standby mode (Step 712). The background noise corresponds to an electrical signal outputted from the detecting unit during periods when neither the determination by the glass breaking sound first wave determining unit or the calculation by the calculating unit is being performed. The criterion used in Step 708 is set with reference to the level of the background noise thus inputted. The background noise may be inputted periodically by using a timer during periods when acoustic waves are not detected. The CPU 10 remains in the standby mode until it receives a start signal from the trigger 12, as shown in FIG. 28. The CPU 10 is restarted when a start signal is inputted (Step 768).

If Step 708 determines that the inputted value is equal to or greater than the criterion, it is determined that the first waves of a glass breaking sound have occurred. Then, the CPU 10 detects peak values of the value a and the value b occurring (Step 714), integrates the value a or the value b (Step 716), and integrates the value c (Step 718), during 10 ms following the first wave rising (Step 720). The processing in Step 714 corresponds to the maximum peak value detecting means.

Figure 28:
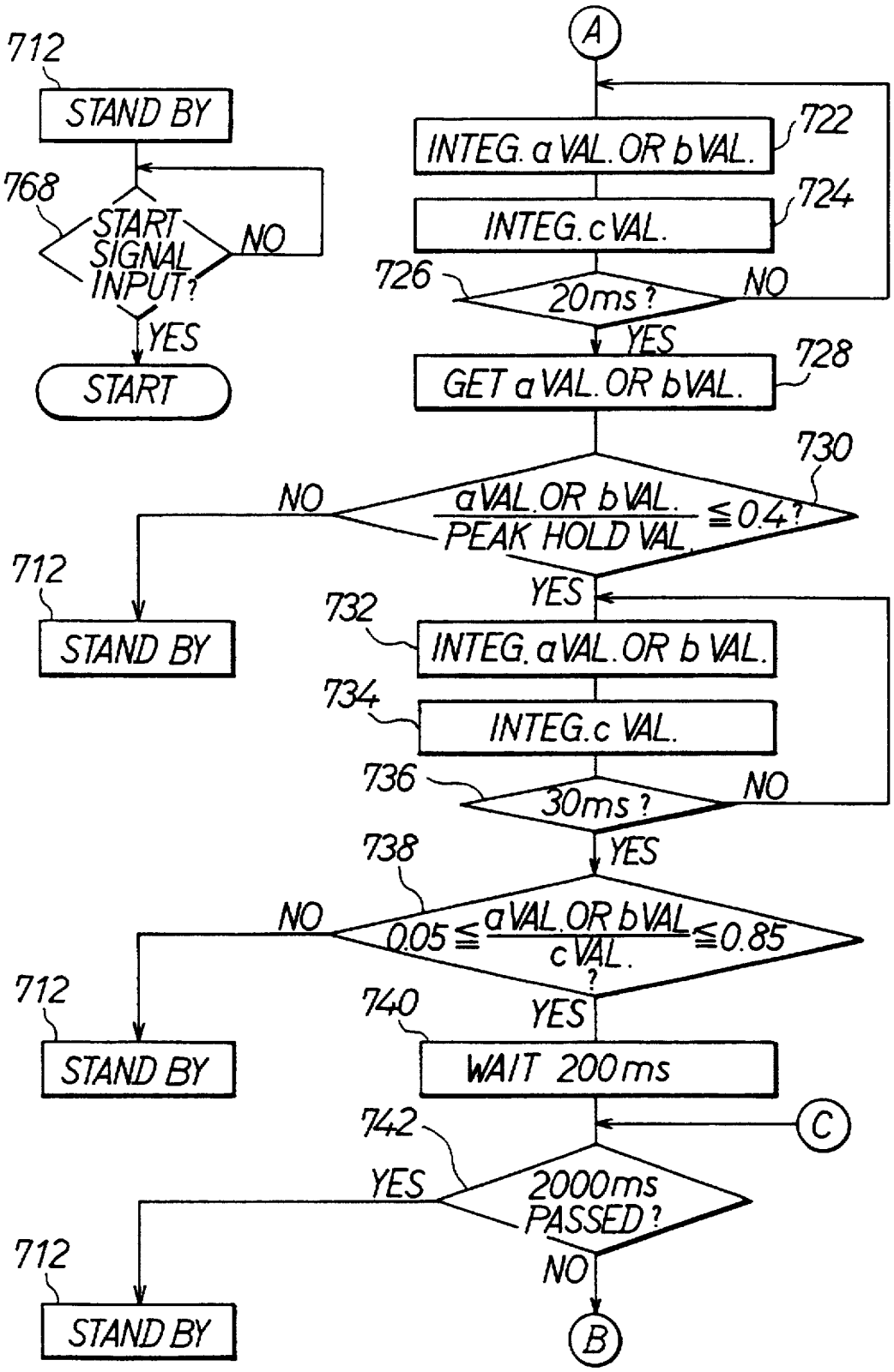
Figure 29:
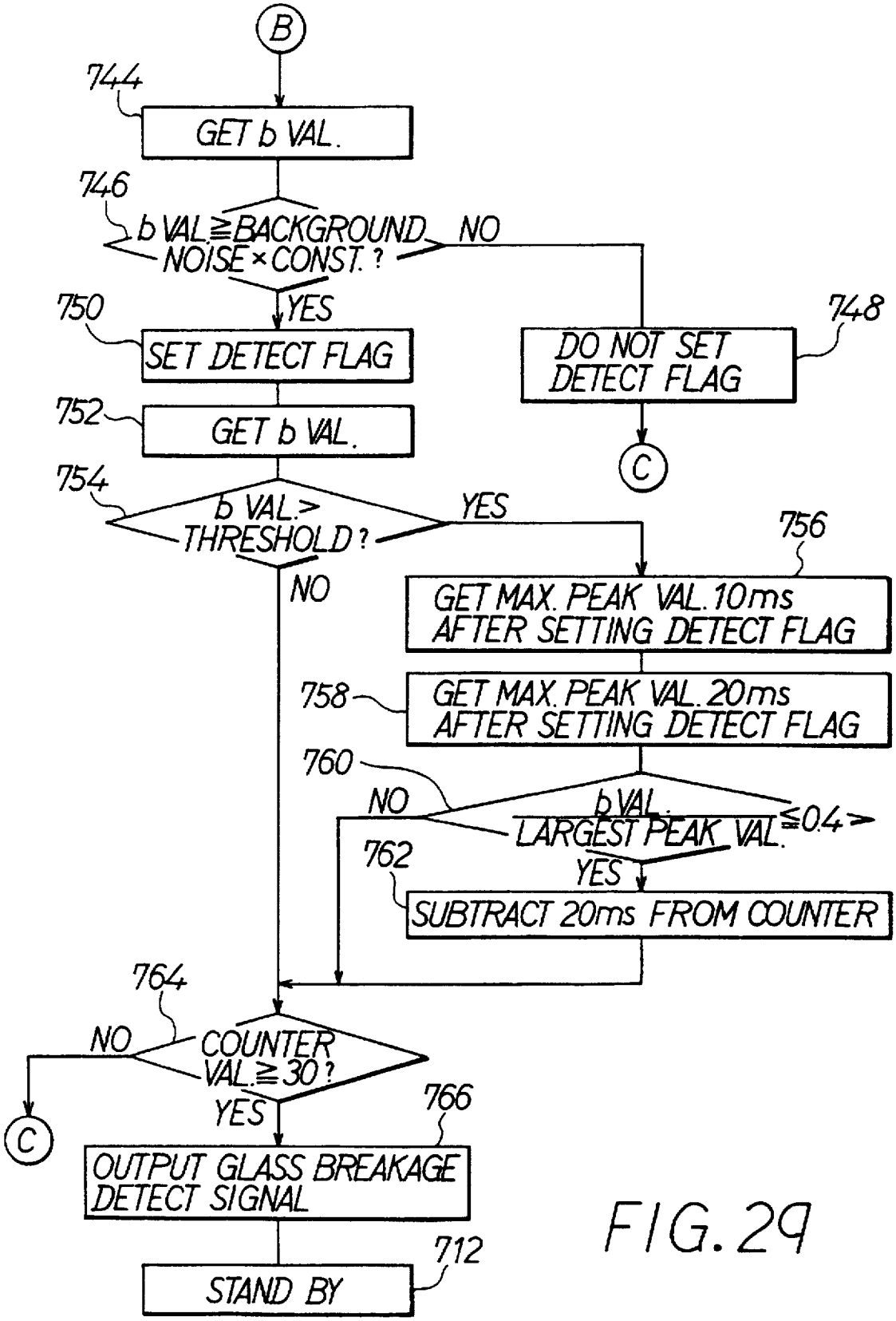

Then, the operation proceeds to Step 722 in FIG. 28. The CPU 10 integrates the value a or the value b (Step 722) and integrates the value c (Step 724) during 20 ms following the rising (Step 726). When 20 ms elapses following the rising (corresponding to the second predetermined time), the CPU 10 inputs the value a or the value b (Step 728), and calculates a ratio of the inputted value to the peak value (corresponding to the relative level calculating means) and determines whether the ratio is equal to or less than 0.4 (Step 730). If the ratio is greater than 0.4, it is determined that the detected acoustic waves are not the first waves of a glass breaking sound, and the CPU 10 enters standby mode (Step 712).

If the condition in Step 730 is met, it is determined that the detected acoustic waves exhibit the attenuating characteristics of the first waves. Then, the CPU 10 integrates the value a or the value b (step 732) and integrates the value c (step 734) during 30 ms following the rising (corresponding to the first predetermined time period) (Step 736). Then the CPU 10 calculates the value of a ratio of the value a or the value b to the value c (corresponding to the calculating means), and determines whether the ratio is within the range of 0.05≦the ratio≦0.85 (Step 738). If the ratio is not in the range of 0.05≦the ratio≦0.85, the CPU 10 enters standby mode (Step 712).

If the condition in Step 738 is met, it is determined that the detected acoustic waves have the relative strength of the high frequency components of the first waves. Then, the CPU 10 waits for a period of time (200 ms) during which the first waves sufficiently attenuate (Step 740). The processing of making the affirmative determination in Step 738 corresponds to the first wave determining means.

During a time period between 200 ms and 2000 ms (corresponding to the third predetermined time period), the CPU 10 inputs the value b (Step 744), and determines whether the inputted value b is equal to or greater than the value (background noise×constant). If the condition in Step 746 is met, it is determined that there have been acoustic waves that need determination, and the CPU 10 sets a detection flag (Step 750), and inputs the value b (Step 752). Then the CPU 10 determines whether the inputted value b is greater than the predetermined criterion (Step 754). If this condition is met, it is determined that there are acoustic waves that need to be examined for an impact sound, and the operation proceeds to Step 756. If the condition in Step 754 is not met, it is determined that the detected acoustic waves are not an impact sound, and the operation proceeds to Step 764.

Step 756 detects a maximum peak value occurring in 10 ms following the setting of the detection flag. The CPU 10 inputs the value b occurring 20 ms after the detection flag has been set up (Step 758). Then, the CPU 10 determines whether the ratio of the value b to the maximum peak value is equal to or less than 0.4 (Step 760). If this condition is met, it is determined that after detection of the first waves, an impact attenuating sound produced through mischievous action or the like has occurred, not the second waves. Then, the CPU 10 subtracts 20 from the counter value (Step 762), and proceeds to Step 764. The processing in Step 762 corresponds to the correcting means. Although this embodiment performs only determination regarding attenuation, incorporation of the high frequency component ratio processing will improve determination precision. The counter value is incremented by 1 when the detection flag is set up by a 1 ms interrupt. Therefore, the counter value indicates the accumulated time when the detection signal reaches the value (background noise×constant), and corresponds to the extent of the electrical signal that exceeds the predetermined level. If the condition in Step 760 is not met, it is determined that there is no attenuating sound, and the operation proceeds to Step 764.

Step 764 determines whether the counter value has reached 30. If the counter value has not reached 30, the operation returns to Step 742 in FIG. 28. If the counter value has reached 30, it is determined that the detected acoustic waves exhibit the slow attenuating characteristics of the second waves, and the CPU 10 outputs the glass breakage detection signal (Step 766), and enters the standby mode (Step 712). The processing of making affirmative determination in Step 764 corresponds to the second wave determining means. The processing in Step 766 corresponds to the outputting means.

As described above, this embodiment does not employ a conventional construction where glass breakage is detected depending on whether the signal level of a particular frequency component reaches a threshold, but determines occurrence of glass breakage by determining occurrence of the first waves on the basis of the attenuating characteristics of detected sound and the relative strength of the high frequency components and detecting the second waves on the basis of the slow attenuating characteristics while avoiding detecting the second waves in the case of an impact sound. In this way, the embodiment provides high precision detection. In addition, the employment of the logical product of these conditions provides sufficiently high precision even if the threshold and range used to determine the attenuating characteristics of a detected sound and a relative strength of the high frequency components are provided with greater allowances or latitudes than when the conditions are individually determined.

As described above, the present invention is able to detect glass breakage with high accuracy by determining occurrence of the first waves of a glass breaking sound on the basis of the relative strength of the high frequency components included in detected sounds. In addition, by using the relative level of detected sounds, the invention can detect the first waves with an even higher accuracy. In addition, by considering the continuity of a detected sound after detection of the first waves, the invention can detect the second waves of a glass breaking sound with a high accuracy. By such detection of the first and second waves, the invention further improves accuracy in detection of glass breakage. Even if continual impacts occur through mischievous actions, the invention avoids determining the impacts as a glass breaking sound by detecting the attenuating characteristics, thus providing a highly accurate detecting device. In addition, by performing determination based on the relative strength of the high frequency components included in acoustic waves, the invention can avoid determining complex impact sounds produced by a hard body and a soft body as glass breakage.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. A glass breakage detecting device for determining occurrence of glass breakage based on detection of at least a first acoustic wave produced at an instance of glass breakage among acoustic waves resulting from glass breakage that include a second acoustic wave produced by scattering of glass pieces after the first wave, the device comprising:

detecting means for converting an acoustic wave into an electrical signal and outputting the electrical signal;

first calculating means for calculating a ratio a plurality of high frequency components to all frequency components of the electrical signal from the detecting means over a first predetermined time period beginning at a time point at which the electrical signal reaches a predetermined value;

first wave determining means for determining that the first wave has occurred when the ratio a plurality of the high frequency components to all components calculated by the calculating means is within a predetermined range; and outputting means for outputting a glass breakage determination signal based on the determination of occurrence of the first wave made by the first wave determining means.

2. The device of claim 1, wherein:

the detecting means includes a high-pass filter for receiving the electrical signal and generating an output signal having frequencies not greater than a first predetermined frequency suppressed; and the calculating means is for calculating the ratio of high frequency components to all frequency components occurring during the first predetermined time period based on the electrical signal and the output signal.

3. The device of claim 2, wherein the calculating means is for calculating the ratio of the high frequency components to all components as a ratio of an integral of the electrical signal within the first predetermined time period to an integral of the output signal within the first predetermined time period.

4. The device of claim 3, wherein the first wave determining means is for determining occurrence of the first wave if the ratio calculated by the calculating means is not less than 0.05 and not greater than 0.37.

5. A glass breakage detecting device according to claim 4, wherein the first wave determining means is for determining occurrence of the first wave if the ratio calculated by the calculating means is not less than 0.05 and not greater than 0.48 when the integral of the output signal is equal to or greater than a predetermined value.

6. The device of claim 2, wherein:

the calculating means includes smoothing means for smoothing the electrical signal and the output signal by rectification; and the calculating means is for calculating the ratio of the high frequency components to all frequency components occurring within the first predetermined time period based on the electrical signal and the output signal smoothed by the smoothing means.

7. The device of claim 1, wherein:

the detecting means includes a first high-pass filter for receiving the electrical signal and generating an output signal having frequencies not greater than a first predetermined frequency suppressed as a first signal, and a second high-pass filter for receiving the electrical signal and generating an output signal having frequencies not greater than a second predetermined frequency suppressed as a second signal, the second predetermined frequency being lower than the first predetermined frequency; and the calculating means is for calculating as the ratio a ratio of an integral of the first signal within the first predetermined time period to an integral of the second signal within the first predetermined time period.

8. The device of claim 7, wherein the first wave determining means is for determining occurrence of the first wave if the ratio calculated by the calculating means is not less than 0.05 and not greater than 0.37.

9. A glass breakage detecting device according to claim 8, wherein the first wave determining means is for determining occurrence of the first wave if the ratio calculated by the calculating means is not less than 0.05 and not greater than 0.48 when the integral of the second signal is equal to or greater than a predetermined value.

10. The device of claim 7, wherein:

the calculating means includes smoothing means for smoothing the first and second signals by rectification; and the calculating means is for calculating the ratio of an integral of the first signal within the first predetermined time period to an integral of the second signal within the first predetermined time period based on the first and second signals smoothed by the smoothing means.

11. The device of claim 1, wherein:

the calculating means includes attenuation amount calculating means for calculating an extent of attenuation of an acoustic wave represented in the electrical signal; and the first wave determining means is for determining occurrence of the first wave in accordance with an extent of attenuation calculated by the attenuation amount calculating means when the ratio of the high frequency components to all frequency components is within the predetermined range.

12. The device of claim 11, wherein the attenuation amount calculating means comprises:

maximum peak value detecting means for detecting a maximum peak value of the electrical signal; and relative level calculating means for calculating a relative level of an acoustic wave from a ratio of the electrical signal to a maximum peak value occurring after a second predetermined time period passes after the electrical signal has reached the predetermined value.

13. The device of claim 11, further comprising:

second wave determining means for determining occurrence of the second wave if an extent of the electrical signal exceeding a predetermined threshold reaches a predetermined value within a third predetermined time period after the first wave determining means has determined occurrence of the first wave;

wherein the outputting means is for outputting the determination signal based on determination of occurrence of the first wave made by the first wave determining means and determination of occurrence of the second wave made by the second wave redetermining means.

14. The device of claim 13, further comprising correcting means for, if the first wave is detected by the first wave determining means during the third predetermined time period, correcting an extent of the electrical signal exceeding a predetermined threshold by subtracting therefrom a predetermined amount .

15. The device of claim 1, further comprising:

second wave determining means for determining occurrence of the second wave if an extent of the electrical signal exceeding a predetermined threshold reaches a predetermined value within a third predetermined time period after the first wave determining means has determined occurrence of the first wave;

wherein the outputting means is for outputting the determination signal based on determination of occurrence of the first wave made by the first wave determining means and determination of occurrence of the second wave made by the second wave determining means.

16. The device of claim 15, further comprising correcting means for, if the first wave is detected by the first wave determining means during the third predetermined time period, correcting an extent of the electrical signal exceeding a predetermined threshold by subtracting therefrom a predetermined amount.

17. A glass breakage detecting device for determining occurrence of glass breakage based on detection of a first acoustic wave produced at an instance of glass breakage and a second acoustic wave produced by scattering of glass pieces after the first wave, the device comprising:

detecting means for converting an acoustic wave into an electrical signal and outputting the electrical signal;

determining means for determining whether the first wave is present based on the electrical signal outputted from the detecting means;

calculating means for calculating an extent of the electrical signal outputted from the detecting means which exceeds a predetermined level during a predetermined time period after the first wave is detected by the determining means;

outputting means for, if the extent calculated by the calculating means exceeds a predetermined value, detecting that the second wave is detected and outputting a glass breakage determination signal;

component ratio calculating means for calculating a ratio a plurality of high frequency components of the electrical signal outputted from the detecting means to all components of the electrical signal after the first wave has been detected, the high frequency components having a frequency not less than a first predetermined frequency; and second correcting means for, based on the value calculated by the component ratio calculating means, correcting an extent of the electrical signal exceeding the predetermined level in accordance with a degree where the ratio a plurality of the high frequency components to all components of the electrical signal is present in a predetermined range.

18. The device of claim 17, further comprising first correcting means for, if the first wave is detected by the determining means during the predetermined time period, correcting the extent calculated by the calculating means by subtracting therefrom a predetermined amount.

19. The device of claim 17, wherein the calculating means includes means for determining the predetermined level based on a level of the electrical signal outputted from the detecting means during a period when neither the determination by the determining means or the calculation by the calculating means is being performed.

20. The device of claim 17, wherein the correcting means is for allowing an extent of the electrical signal exceeding the predetermined level to be calculated by the calculating means only during a period when the relative strength of the high frequency components is within the predetermined range.

21. The device of claim 17, wherein:

the detecting means includes a first high-pass filter for suppressing frequencies not greater than a first predetermined frequency and a second high-pass filter for suppressing frequencies not greater than a second predetermined frequency that is lower than the first predetermined frequency; and the component ratio calculating means is for calculating a value representative of the relative strength of the high frequency components in accordance with an integral of the electrical signals outputted from the first high-pass filter and the second high-pass filter.

22. The device of claim 17, wherein the detecting means includes a high-pass filter for receiving the electrical signal and suppressing frequencies therein not greater than a first predetermined frequency, and for using an output signal from the high-pass filter as the electrical signal.

23. The device of claim 17, wherein the calculating means includes smoothing means for rectifying the electrical signal outputted from the detecting means and then smoothing the rectified electrical signal;

wherein calculating means is for processing an output signal from the smoothing means as the electrical signal.

24. A glass breakage detecting device according to claim 23, wherein:

the determining means includes maximum peak value detecting means for detecting a maximum peak value of a wave included in the electrical signal outputted from the detecting means; and the determining means is for detecting whether the first wave is present based on a time change characteristic of a ratio of a level of the electrical signal outputted from the smoothing means to the maximum peak value.

25. The device of claim 17, wherein the determining means is for determining whether the first wave is present in accordance with an attenuation characteristic of a wave included in the electrical signal outputted from the detecting means.

26. The device of claim 17, wherein the determining means is for determining whether the first wave is present in accordance with an extent of a relative strength of high frequency components included in the electrical signal outputted from the detecting means.

* * * * *